US005273869A

United States Patent [19]

Tanaka et al.

[11] Patent Number: 5,273,869

[45] Date of Patent: Dec. 28, 1993

[54] LIGHT-SENSITIVE SILVER HALIDE COLOR PHOTOGRAPHIC MATERIAL

[75] Inventors: Shigeo Tanaka; Hirokazu Sato, both of Hino, Japan

[73] Assignee: Konica Corporation, Tokyo, Japan

[21] Appl. No.: 665,962

[22] Filed: Mar. 7, 1991

[30] Foreign Application Priority Data

Mar. 9, 1990 [JP] Japan ..... 2-59373

[51] Int. Cl.[5] ..... G03C 1/46; G03C 7/32

[52] U.S. Cl. ..... 430/505; 430/554; 430/555; 430/556; 430/557; 430/558

[58] Field of Search ..... 430/505, 554, 555, 556, 430/557, 558

[56] References Cited

U.S. PATENT DOCUMENTS 4,994,362 2/1991 Okumura et al. ..... 430/558
5,051,347 9/1991 Uchida et al. ..... 430/558

FOREIGN PATENT DOCUMENTS 0283324 9/1988 European Pat. Off. .
0320778 6/1989 European Pat. Off. .
0410225 1/1991 European Pat. Off. .

*Primary Examiner*—Janet C. Baxter
*Attorney, Agent, or Firm*—Finnegan, Henderson, Farabow, Garrett & Dunner

[57] ABSTRACT

Disclosed is a light-sensitive silver halide color photographic material having a photographic constituent layer containing an yellow color-forming coupler, a magenta color-forming coupler and a cyan color-forming coupler on a reflective support, characterized in that when each coupler is color-formed independently, the rate of a maximum value of CIE 1976L*a*b* color difference between a colored portion and a minimum density portion of cyan relative to a smaller value of yellow or magenta is 80% or more, and $\Delta E_{max}$ which is a maximum value of color difference of cyan is 70 or more

5 Claims, 1 Drawing Sheet

LIGHT-SENSITIVE SILVER HALIDE COLOR PHOTOGRAPHIC MATERIAL

BACKGROUND OF THE INVENTION

This invention relates to a light-sensitive silver halide color photographic material excellent in tone reproducibility and giving sharp printed images, more particularly to a light-sensitive silver halice color photographic material having high sensitivity, excellent in tone reproducibility and background whiteness, and also giving sharp printed images.

For preventing red saturation phenomenon that delicate light and shade cannot be reproduced at a high density portion of red, as disclosed in Japanese Unexamined Patent Publication No. 68754/1989, there has been known a technique in which a silver halide emulsion in a layer containing a dye-forming coupler is spectrally sensitized to a certain wavelength region, and further spectrally sensitized within a limited range to a wavelength region to which a silver halide emulsion in a layer containing another dye-forming coupler is spectrally sensitized. Further, as disclosed in Japanese Unexamined Patent Publication No. 91657/1986, there has been known a technique in which a dye-forming coupler is contained in a silver halide emulsion spectrally sensitized to a certain wavelength region, and further, a dye of a hue which does not substantially contribute to formation of a hue of said dye-forming coupler is added to have a gradation at a specific density region. However, in these techniques, it is extremely difficult to control contrast without deterioration of color reproducibility, and also sharpness of images has not been discussed at all.

SUMMARY OF THE INVENTION

Accordingly, an object of the present invention is to provide a light-sensitive silver halide color photographic material having high sensitivity, excellent in tone reproducibility and background whiteness, and also giving sharp printed images.

The present inventors have investigated intensively in consideration of such a present situation, and consequently found that these problems can be solved by a light-sensitive silver halide color photographic material having a photographic constituent layer containing an yellow color-forming coupler, a magenta color-forming coupler and a cyan color-forming coupler on a reflective support, characterized in that when each coupler is color-formed independently, a ratio of a maximum value of CIE (Commission Internationale de I'Eclairage) 1976 L*a*b* color difference ($\Delta E$) between a colored portion and a minimum density portion of cyan relative to a smaller value of that of yellow or magenta is 80% or more, and $\Delta E_{max}$ which is a maximum value of color difference of cyan is 70 or more, whereby excellent tone reproducibility and sharp images can be obtained, to accomplish the present invention.

DESCRIPTION OF THE PREFERRED EMBODIMENTS

Figure 1:
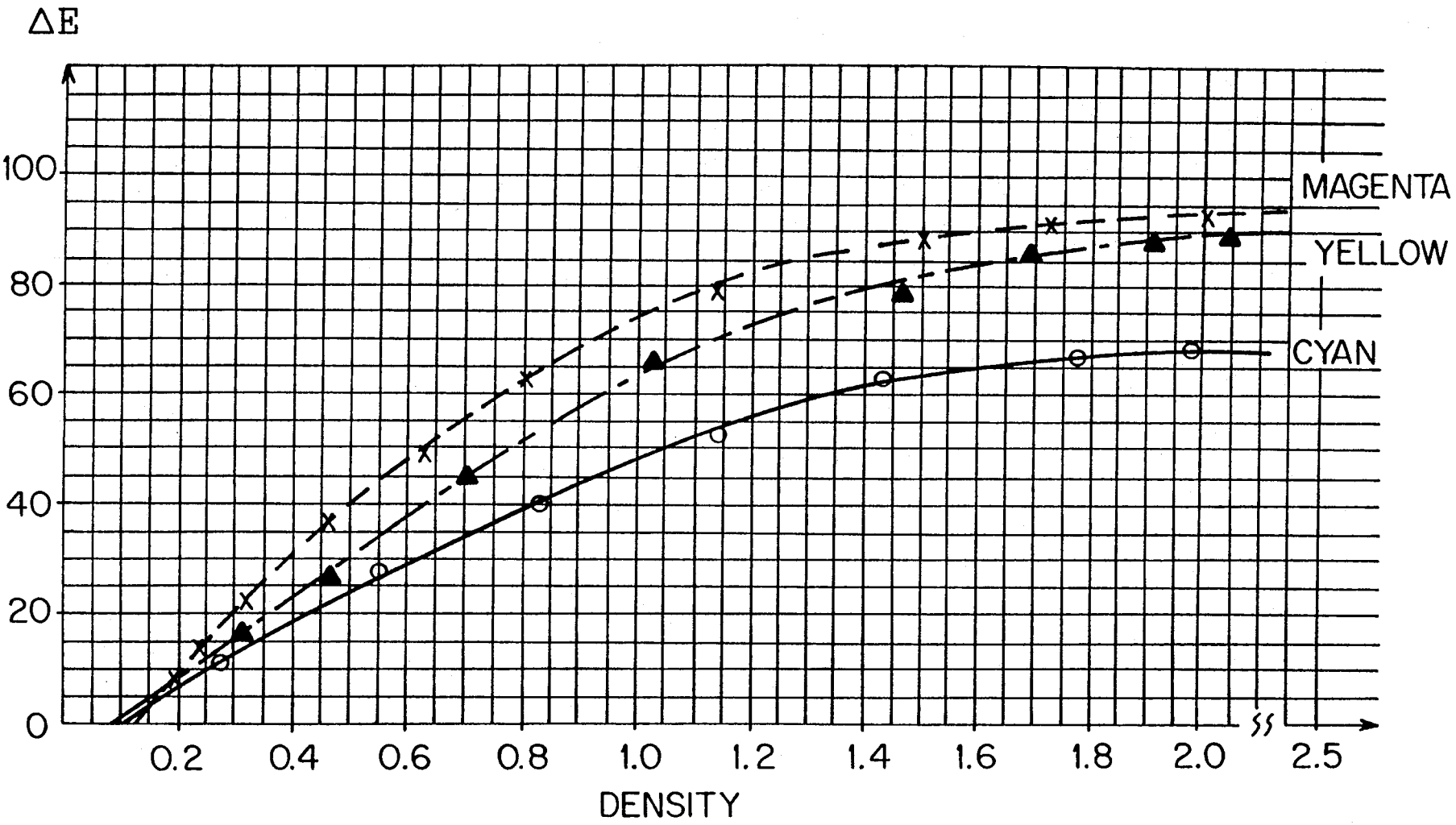
FIG. 1 is a graph in which L*a*b* values of yellow, magenta, cyan and white patches obtained from Sample No. 101 prepared in Example 1 are plotted on the respective lines obtained by measurement by using a PDA-65 densitometer, wherein Δ represents yellow, X magenta and O cyan, respectively.

In the following, the present invention is explained in more detail

For obtaining color difference between a colored portion and a minimum density portion mentioned in the present invention, respective L*, a* and b* values of samples obtained by development processing of samples of a light-sensitive silver halide color photographic material exposed by lights having an appropriate spectral composition or unexposed samples are determined according to the method described in JIS Z-8729, and further measured according to the method described in JIS Z-8730. If problems such as color contamination are caused by this method, evaluation may be made by preparing separately samples not containing couplers or silver halide emulsions which cause color contamination.

Photographic scenes may include, for example, close-up scenes of portraits, scenes of a group of a large number of people, scenes of natural landscapes such as mountains and countrysides and scenes of artificial landscapes such as amusement parks. As a result of studies by the present inventors, it has been clarified that depending on the kind of these scenes, impression of sharpness of images may differ, and among them, in the case of scenes of people such as close-up scenes of portraits and scenes of a group of a large number of people, judgement of sharpness of images may greatly depend on whether features and contours of faces are printed clearly or not. On the other hand, in color prints using color negative films in which color reproducibility is improved to a great extent by interimage effect, it is extremely important to reproduce delicate light and shade at a high density portion of red, namely to overcome red saturation.

As described above, when an antiirradiation dye is used for preventing red saturation and improving sharpness of images, there are inconveniences that dark and quiet impression of images due to slight elevation of a density at unexposed portions is brought about, and that improvement effect of sharpness in the cases of close-up scenes of portraits and scenes of a group of people cannot be observed. On the contrary, according to the present invention, it is possible to omit unnecessary addition of an anti-irradiation dye, whereby the above inconveniences can be cancelled.

For example, even in techniques in which sensitivity is imparted to a light with a wavelength to which a light-sensitive material should not be sensitized originally or quantized continuous tone is formed by mixing couplers having different hues, there is an inconvenience that improvement effect of sharpness in the cases of close-up scenes of portraits and scenes of a group of people cannot be observed. On the contrary, according to the present invention, this inconvenience is cancelled, and also it is possible to obtain simultaneously light red reproduction and prevention of red saturation which cannot be obtained by such a quantized continuous tone, and yet improvement of sharpness of images can be achieved. These results are surprising to the present inventors.

According to a technique for controlling an amount of a coupler dispersion in green-, red- and blue-sensitive emulsions, there is an inconvenience that lowering at a maximum density portion accompanied with contrast reduction cannot be avoided, thereby exerting great influence on sharpness of images. However, in the present invention, even in close-up scenes of portraits and group photographs, impression of sharpness of images can be given.

The value of the color difference may vary depending on the kinds of a coupler or additives to be used for dispersion such as high boiling point solvent and others, and a coated amount. These compounds and amounts thereof may be determined as long as the above conditions are satisfied, but the following compounds are preferably used.

As the respective yellow, magenta and cyan couplers to be used in the present invention, any coupler satisfying the above conditions may be used. In the following, the yellow coupler, cyan coupler and magenta coupler preferably used in the present invention are described.

In the present invention, couplers having the same color hue may be used in combination, but when couplers having different color hues are mixed, the effect of the present invention cannot be obtained.

As a yellow coupler to be used in the present invention, compounds represented by the following formula (Y - I) are preferred.

(Y-I)

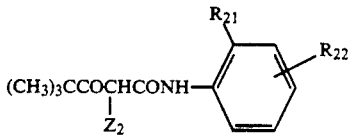

wherein $R_{21}$ represents a halogen atom or an alkoxy group; $R_{22}$ represents $-NHCOR_{23}SO_2R_{24}$, $-COOR_{24}$, $-NHCOR_{24}$, $-COOR_{23}COOR_{24}$,

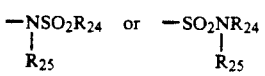

where $R_{23}$ represents an alkylene group; $R_{24}$ represents a diffusion-proof group; $R_{25}$ represents a hydrogen atom, an alkyl group or an aralkyl group; and $Z_2$ represents a group eliminatable by coupling.

In the following, specific examples of the yellow coupler preferably used in the present invention are shown, but the present invention is not limited to these.

(Y-1)

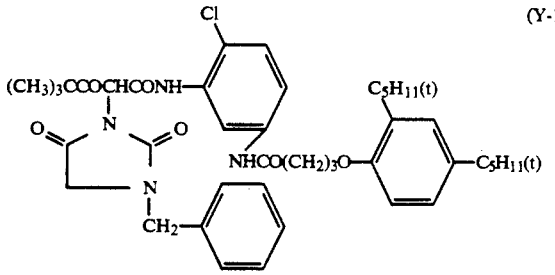

(Y-2)

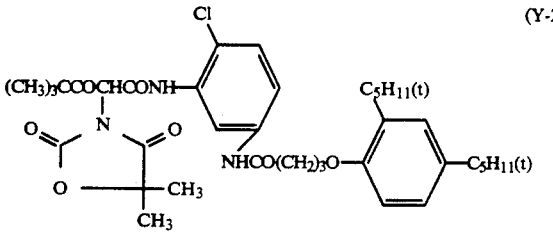

-continued (Y-3)

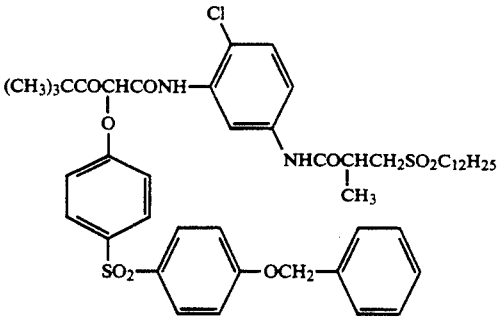

(Y-4)

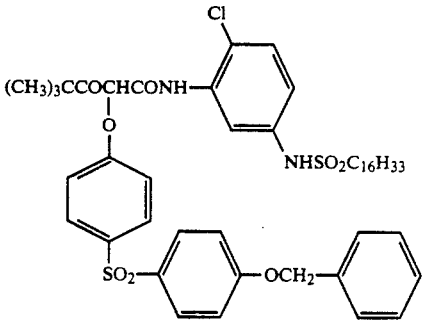

(Y-5)

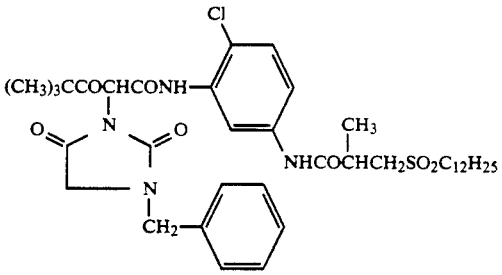

(Y-6)

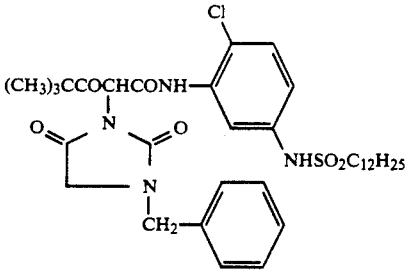

(Y-7)

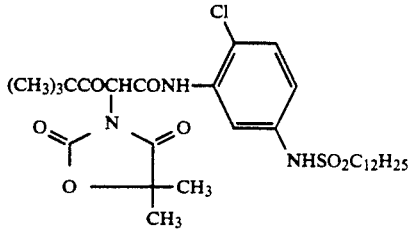

-continued (Y-8)

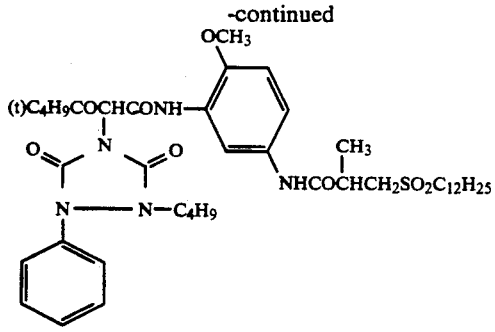

(Y-9)

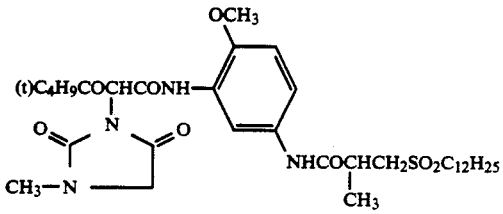

As a magenta coupler to be used in the light-sensitive silver halide material according to the present invention, there may be mentioned magenta couplers represented by the following formulae (M - I) and (M - XI).

(M-I)

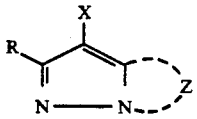

In the formula, Z represents a group of non-metallic atoms necessary for forming a nitrogen-containing heterocyclic ring and a ring represented by said Z may have a substituent group.

X represents a hydrogen atom or a group eliminatable by reaction with an oxidized product of a color developing agent, and R represents a hydrogen atom or a substituent group.

The substituent group represented by R is not particularly limited, but may typically include each group of alkyl, aryl, anilino, acylamino, sulfonamide, alkylthio, arylthio, alkenyl and cycloalkyl, and otherwise a halogen atom and each group of cycloalkenyl, alkynyl, hetero ring, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imide ureido, sulfamoylamino, alkoxycarbonylamino, aryloxycarbonylamino, alkoxycarbonyl, aryloxycarbonyl and heterocyclic thio, and also a spiro compound residue and a bridged hydrocarbon compound residue.

The alkyl group represented by R is preferably an alkyl group having 1 to 32 carbon atom, and may be straight or branched.

The aryl group represented by R is preferably a phenyl group.

The acylamino group represented by R may include an alkylcarbonylamino group and an arylcarbonylamino group.

The sulfonamide group represented by R may include an alkylsulfonylamino group and an arylsulfonylamino group.

As an alkyl component and an aryl component in the alkylthio group and arylthio group represented by R, there may be mentioned the alkyl group and aryl group represented by R described above.

The alkenyl group represented by R is preferably an alkenyl group having 2 to 32 carbon atoms, and the cycloalkyl group is preferably a cycloalkyl group having 3 to 12, particularly 5 to 7 carbon atoms, and the alkenyl group may be straight or branched.

The cyclolalkenyl group represented by R is preferably a cycloalkenyl group having 3 to 12, particularly 5 to 7 carbon atoms.

The sulfonyl group represented by R may include an alkylsulfonyl group and an arylsulfonyl group; the sulfinyl group, an alkylsulfinyl group and an arylsulfinyl group; the phosphonyl group, an alkylphosphonyl group, an alkoxyphosphonyl group, an aryloxyphosphonyl group and an arylphosphonyl group; the acyl group, an alkylcarbonyl group and an arylcarbonyl group; the carbamoyl group, an alkylcarbamoyl group and an arylcarbamoyl group; the sulfamoyl group, an alkylsulfamoyl group and an arylsulfamoyl group; the acyloxy group, an alkylcarbonyloxy group and an arylcarbonyloxy group; the carbamoyloxy group, an alkylcarbamoyloxy group and an arylcarbamoyloxy group; the ureido group, an alkylureido group and an arylureido group; the sulfamoylamino group, an alkylsulfamoylamino group and an arylsulfamoylamino group; the heterocyclic group, preferably 5- to 7-membered groups, specifically including a 2-furyl group, a 2-thienyl group, a 2-pyrimidinyl group and a 2-benzothiazolyl group; the heterocyclic oxy group, preferably groups having 5- to 7-membered hetero rings, for example, a 3,4,5,6-tetrahydropyranyl-2-oxy group and a 1-phenyltetrazole-5-oxy group; the heterocyclic thio group, preferably 5- to 7-membered heterocyclic thio groups, for example, a 2-pyridylthio group, a 2-benzothiazolylthio group and a 2,4-diphenoxy-1,3,5-triazole-6-thio group; the siloxy group, a trimethylsiloxy group, a triethylsiloxy group and a dimethylbutylsiloxy group; the imide group, a succinimide group, a 3-heptadecyl succinimide group, a phthalimide group, a glutarimide group; the spiro compound residue, spiro[3.3]heptan-1-yl; and the bridged hydrocarbon compound residue, bicyclo[2.2.1]heptan-1-yl, tricyclo[3.3.1.1$^{3,7}$]decan-1-yl and 7,7-dimethyl-bicyclo[2.2.1]-heptan-1-yl.

As the group represented by X, which can be eliminated by reaction with an oxidized product of a color developing agent, there may be mentioned, for example, a halogen atom (a chlorine atom, a bromine atom and a fluorine atom) and each group of alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxycarbonylthio, acylamino, sulfonamide, nitrogen-containing hetero ring which is bonded by N atom, an alkyloxycarbonylamino, aryloxycarbonylamino, carboxyl and (M-I)

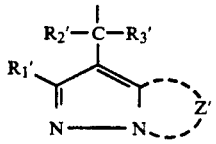

(where $R_1'$ has the meaning as the above R; Z' has the same meaning of the above Z; and $R_2'$ and $R_3'$ each represent a hydrogen atom, an aryl group, an alkyl group or a heterocyclic group), preferably a halogen atom, particularly preferably a chlorine atom.

The nitrogen containing hetero ring formed by Z or Z' may include a pyrazole ring, an imidazole ring, a triazole ring or a tetrazole ring, and the substituent group which may be possessed by the above ring may include the groups in the description of the above R.

The compound represented by the formula (M-I) is more specifically represented by, for example, the following formulae (M - II) to (M - VII).

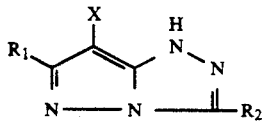
(M-II)

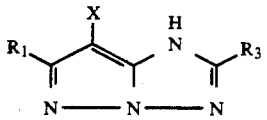
(M-III)

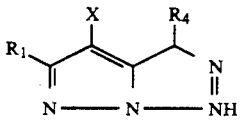
(M-IV)

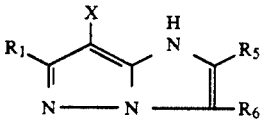
(M-V)

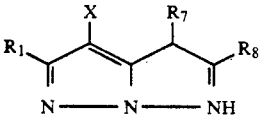
(M-VI)

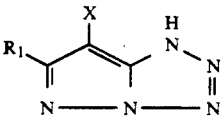
(M-VII)

In the above formula (M - II) to formula (M - VII), $R_1$ to $R_8$ and X have the same meaning of the above R.

In formula (M - I), those represented by the following formula (M - VIII) are preferred.

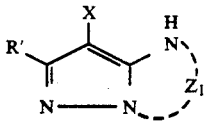
(M-VIII)

wherein $R_1$, X and Z; have the same meanings as R, X and Z in the formula (M - I), respectively.

Among the magenta couplers represented by the above formula (M - II) to formula (M - VII), the coupler represented by the formula (M - II) is particularly preferred.

As the above substituent groups R and $R_1$ on a hetero ring, those represented by the following formula (M - IX) are most preferred.

$$R_9—CH_2— \qquad \text{(M -IX)}$$

wherein $R_9$ has the same meaning as the above R.

$R_9$ is preferably a hydrogen atom or an alkyl group.

As a substituent group which may be possessed by the ring formed by Z in the formula (M - I) and the ring formed by $Z_1$ in the formula (M - VIII), and as $R_2$ to $R_8$ in the formula (M - II) to the formula (M - VI), those represented by the formula (M - X) are preferred.

$$—R^1—SO_2—R^2 \qquad \text{(M - X)}$$

wherein $R^1$ represents an alkylene group; and $R^2$ represents an alkyl group, a cycloalkyl group or an aryl group.

The alkylene group represented by $R^1$ is an alkylene group having preferably 2 or more, more preferably 3 to 6 carbon atom in its straight portion, and may be straight or branched.

The alkyl group represented by $R^2$ is preferably 5- or 6membered.

In the following, representative specific examples of the compound represented by the above formula (M-I) are shown.

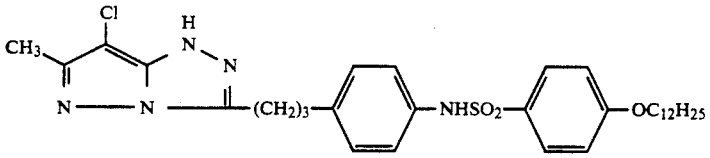
[M-1]

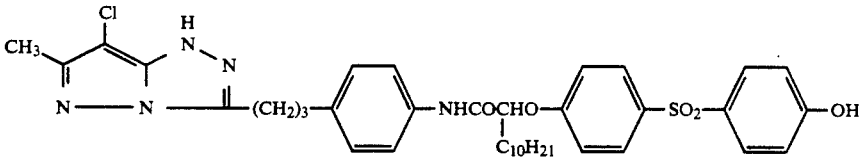
[M-2]

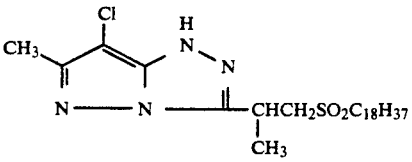
[M-3]

-continued
[M-4]
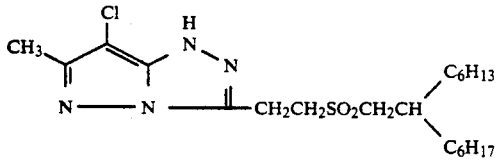
[M-5]
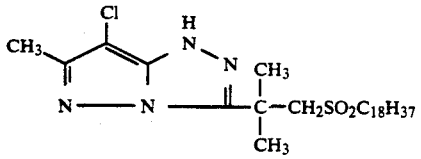
[M-6]
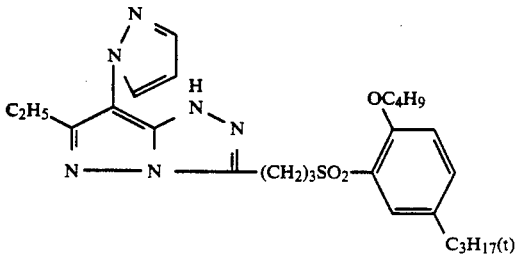
[M-7]
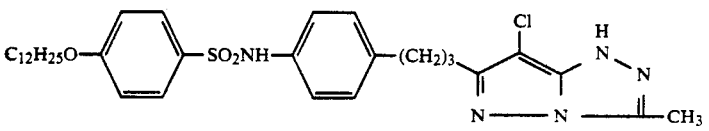
[M-8]
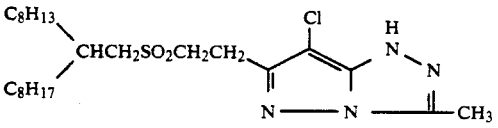
[M-9]
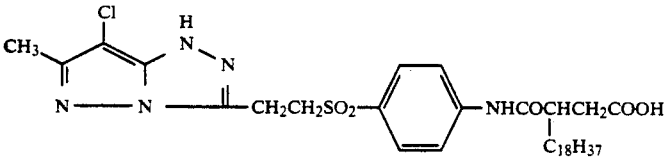
[M-10]
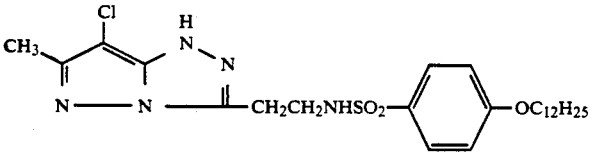
[M-11]
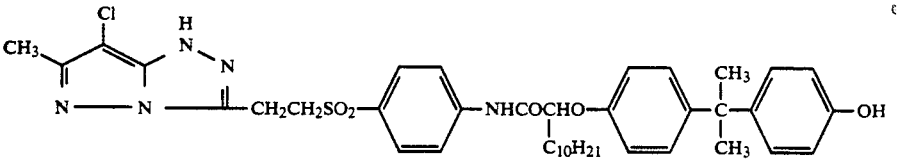
[M-12]
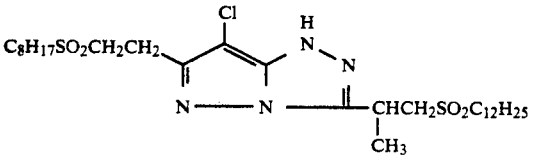

-continued
[M-13]
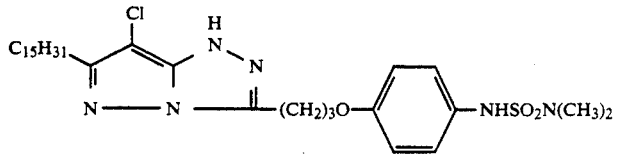
[M-14]
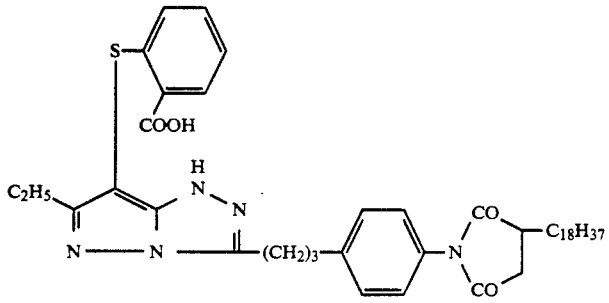
[M-15]
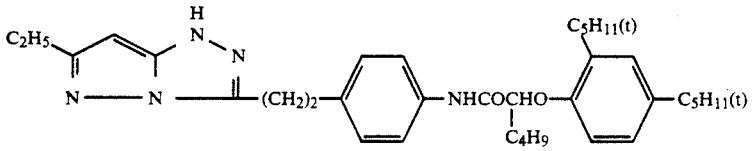
[M-16]
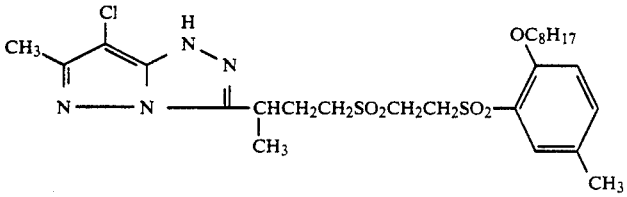
[M-17]
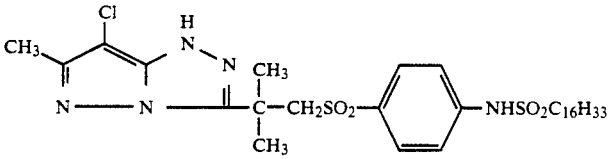
[M-18]
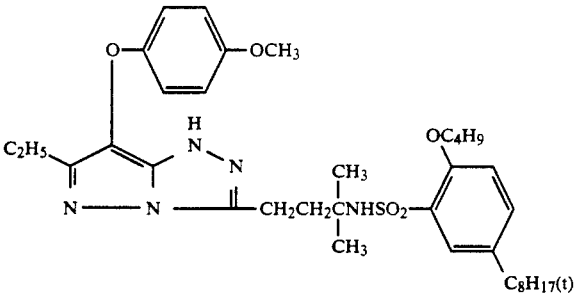
[M-19]
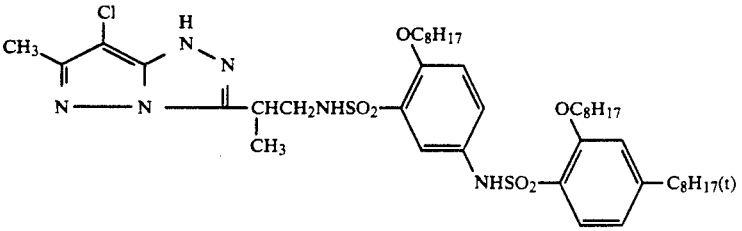

-continued
[M-20]
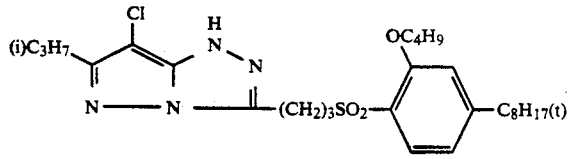
[M-21]
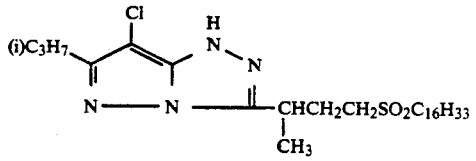
[M-22]
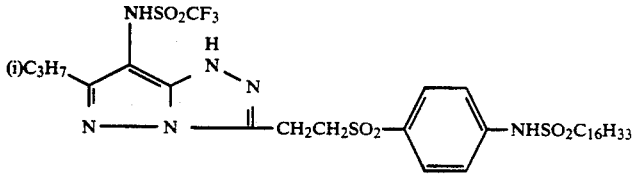
[M-23]
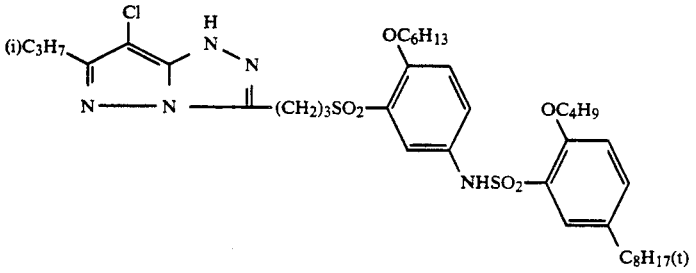
[M-24]
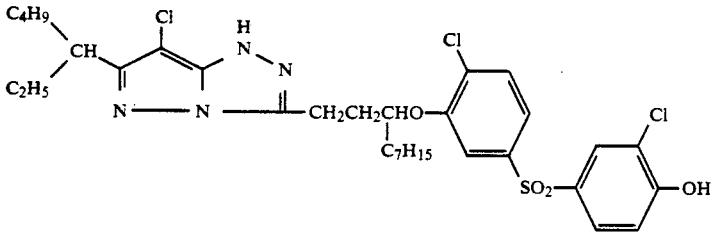
[M-25]
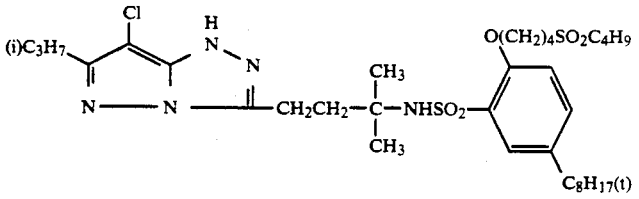
[M-26]
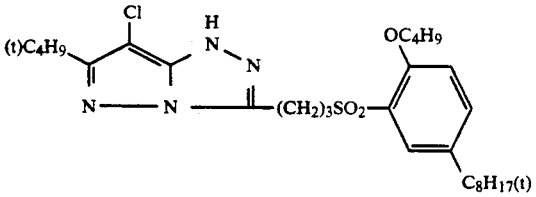
[M-27]
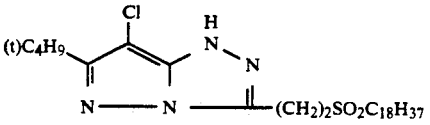

-continued
[M-28]
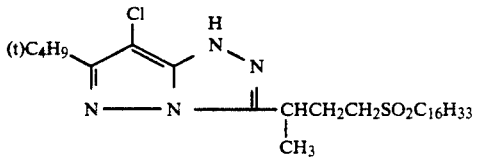
[M-29]
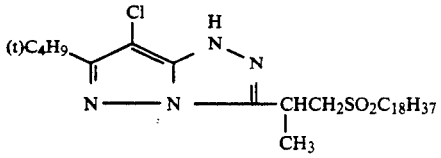
[M-30]
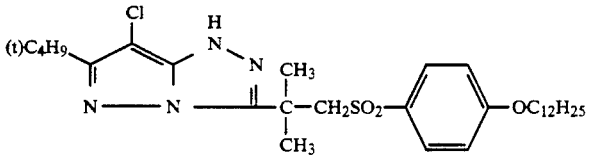
[M-31]
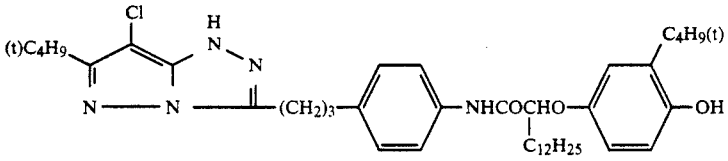
[M-32]
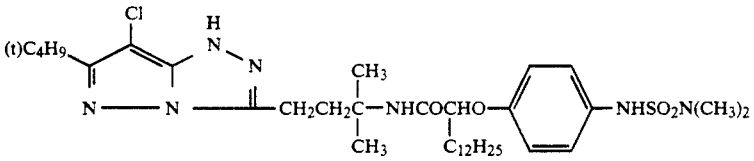
[M-33]
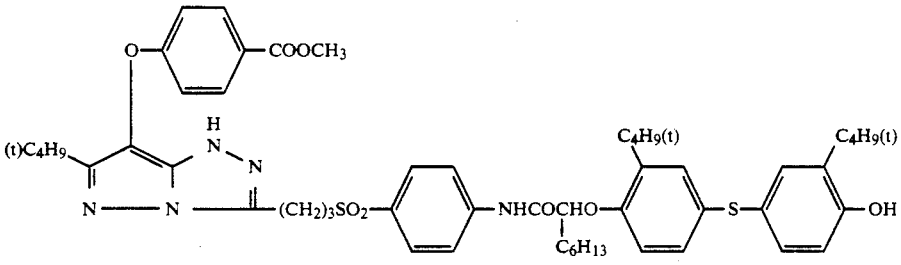
[M-34]
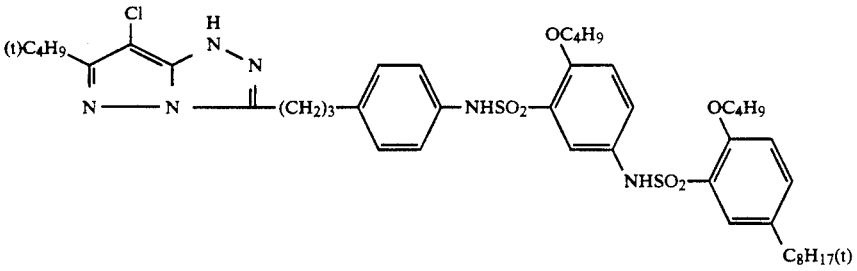
[M-35]
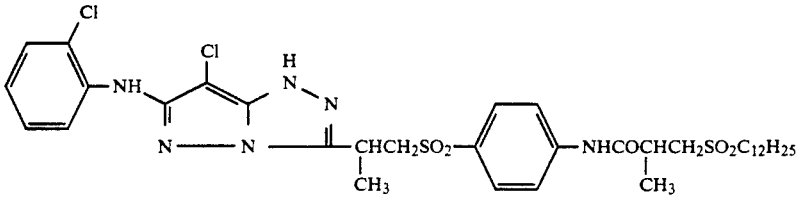

-continued
[M-36]
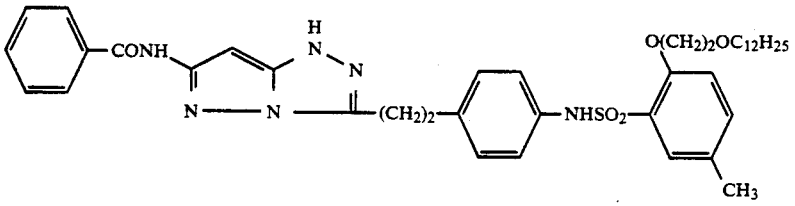
[M-37]
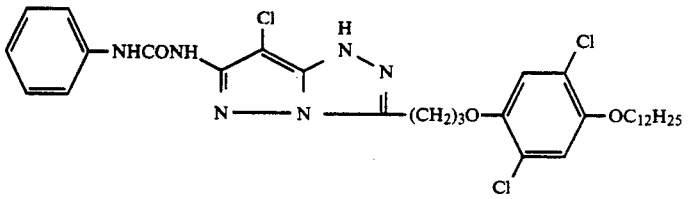
[M-38]
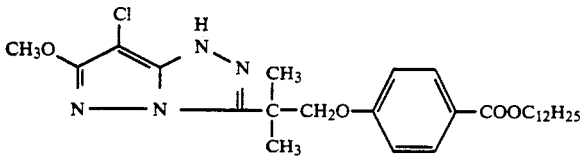
[M-39]
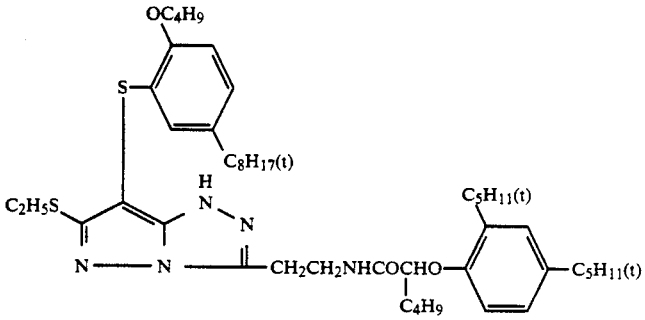
[M-40]
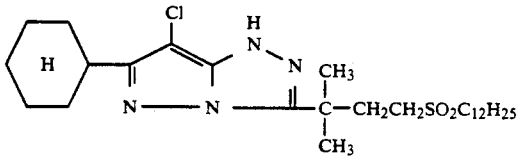
[M-41]
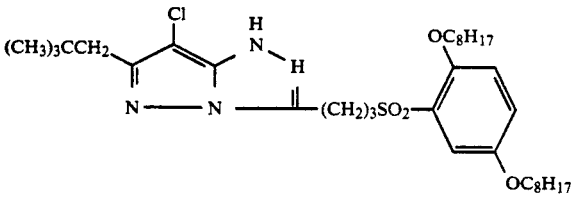
[M-42]
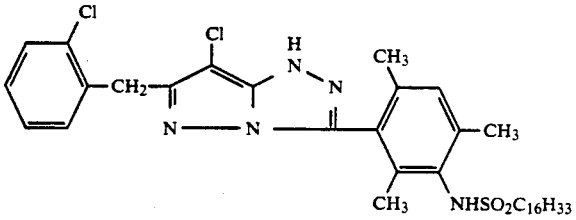

-continued
[M-43]
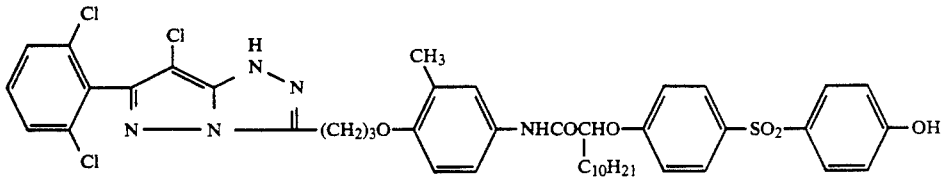
[M-44]
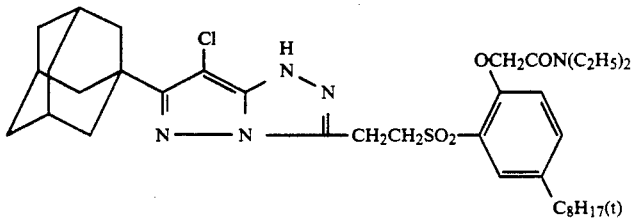
[M-45]
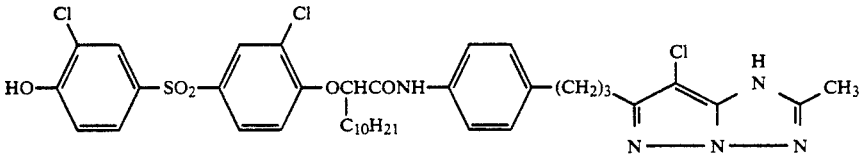
[M-46]
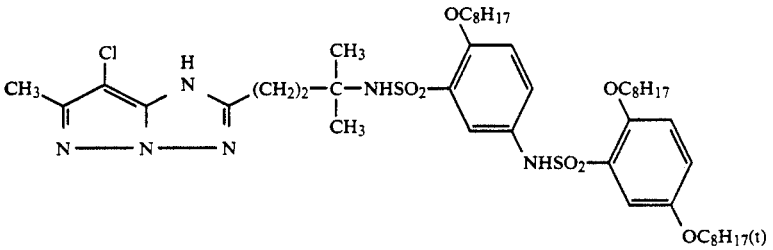
[M-47]
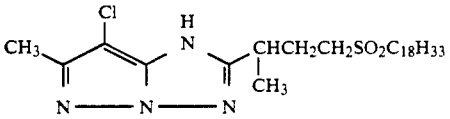
[M-48]
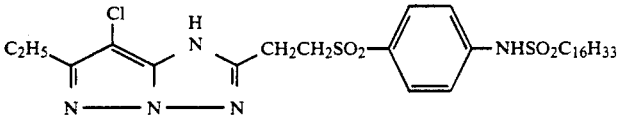
[M-49]
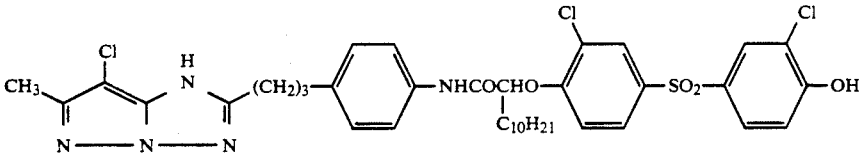
[M-50]
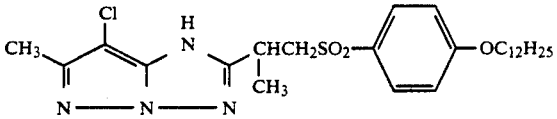
[M-51]
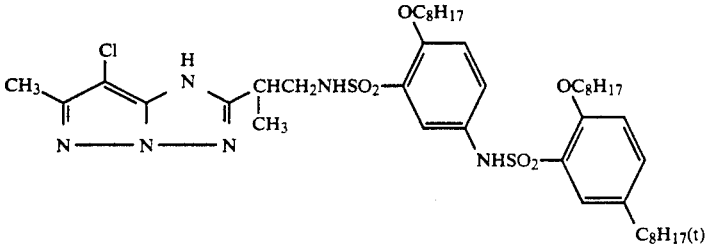

-continued
[M-52]
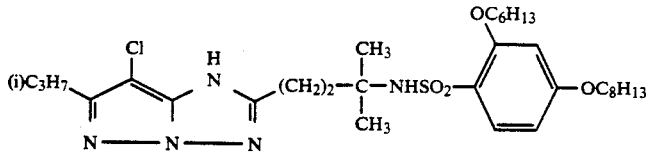
[M-53]
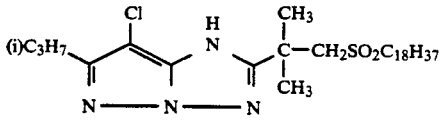
[M-54]
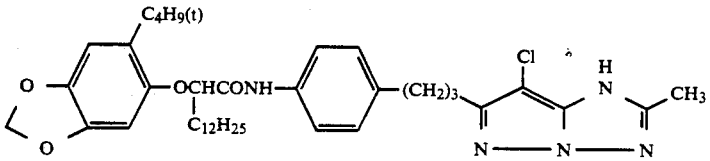
[M-55]
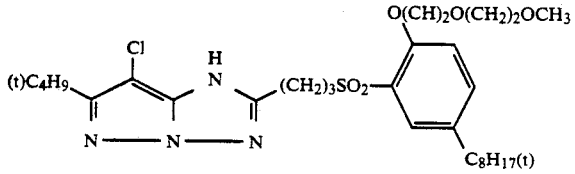
[M-56]
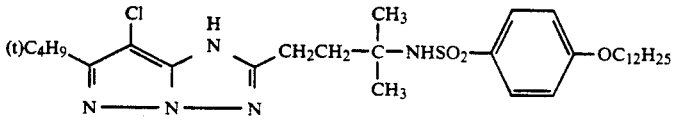
[M-57]
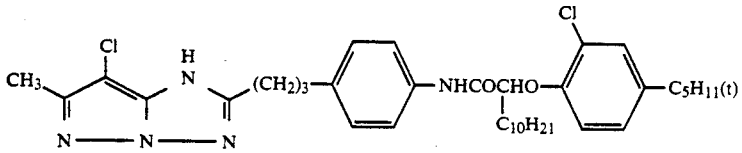
[M-58]
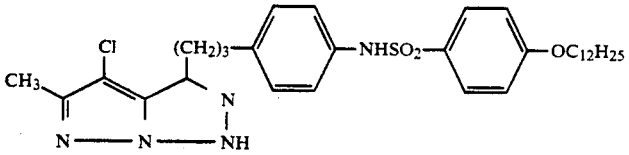
[M-59]
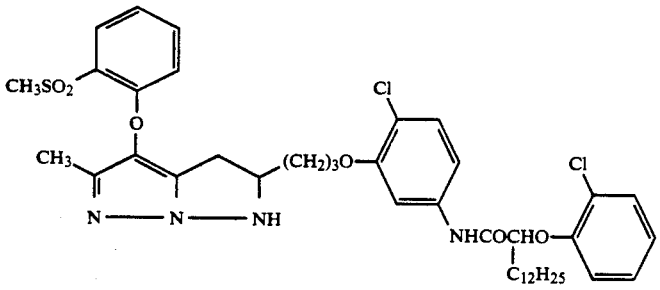
[M-60]
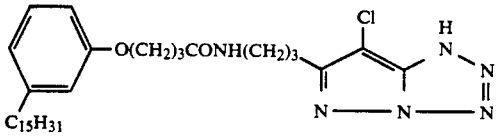

-continued

[M-61]

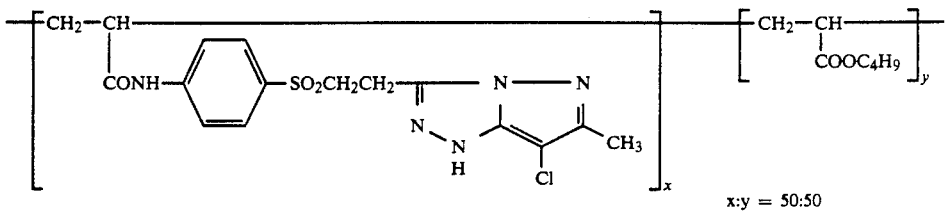

x:y = 50:50

[M-62]

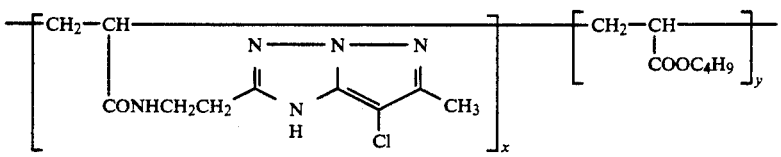

x:y = 50:50

Other than the above specific examples of the magenta coupler, the magenta coupler preferably used in the present invention is a compound represented by the following formula (M - XI).

(M-XI)

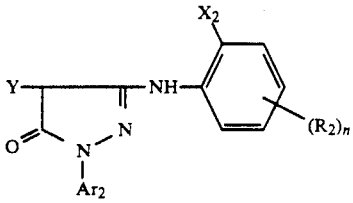

In the formula, $Ar_2$ represents an aryl group, $X_2$ represents a halogen atom, an alkoxy group or an alkyl group, and $R_2$ represents a group with which a benzene ring can be substituted.

n represents 1 or 2. When n is 2, $R_2$'s may be the same groups or different groups.

Y represents a hydrogen atom or a group which can be eliminated by coupling reaction with an oxidized product of an aromatic primary amine type color developing agent.

In the formula (M - XI), as the group represented by Y, which can be eliminated by coupling reaction with an oxidized product of an aromatic primary amine type color developing agent, there may be mentioned, for example, a halogen atom. an alkoxy group, an aryloxy group, an acyloxy group, an arylthio group, an alkylthio group and

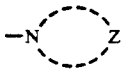

(where Z represents a group of atoms necessary for forming a 5- or 6-membered ring by an atom selected from a carbon atom, an oxygen atom, a nitrogen atom and a sulfur atom together with a nitrogen atom). Here, Y does not represent a hydrogen atom.

In the following, specific examples of the group represented by Y are described.

The halogen atom may include atoms such as chlorine, bromine and fluorine; the alkoxy group, an ethoxy group, a benzyloxy group, a methoxyethylcarbamoylmethoxy group and a tetradecylcarbamoylmethoxy group; the aryloxy group, a phenoxy group, a 4-methoxyphenoxy group and a 4-nitrophenoxy group; the acyloxy group, an acetoxy group, a myristoyloxy group and a benzoyloxy group; the arylthio group, a phenylthio group, a 2-butoxy-5-octylphenylthio group and a 2,5-dihexyloxyphenylthio group; the alkylthio group, a methylthio group, an octylthio group, a hexadecylthio group, a benzylthio group, a 2-(diethylamino)ethylthio group, an ethoxycarbonylmethylthio group, an ethoxydiethylthio group and a phenoxyethylthio group; and

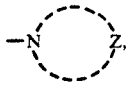

a pyrazolyl group, an imidazolyl group, a triazolyl group and a tetrazolyl group.

In the following, specific examples of the magenta coupler preferably used in the present invention, but the present invention is not limited to these.

Examples of the compound represented by the above formula (M - XI) are shown below.

[M-63]
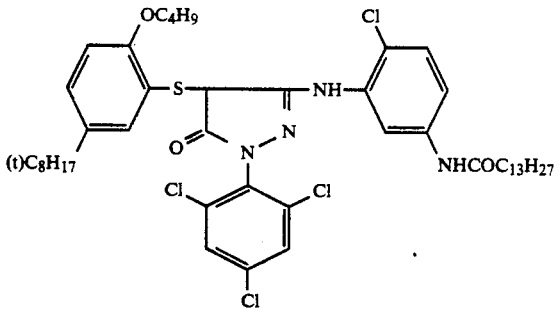
[M-64]
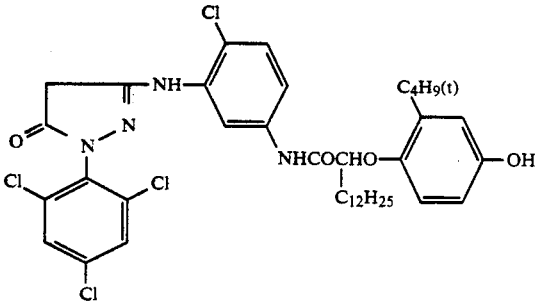
[M-65]
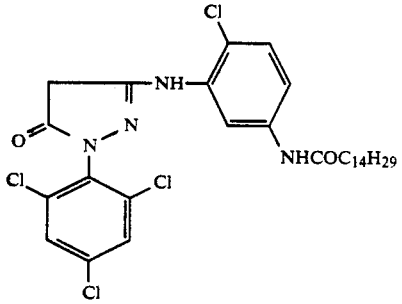
[M-66]
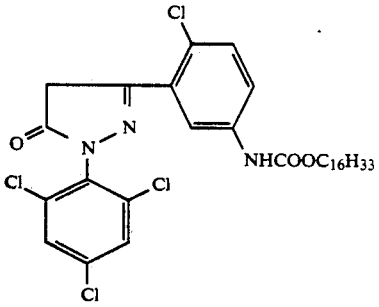
[M-67]
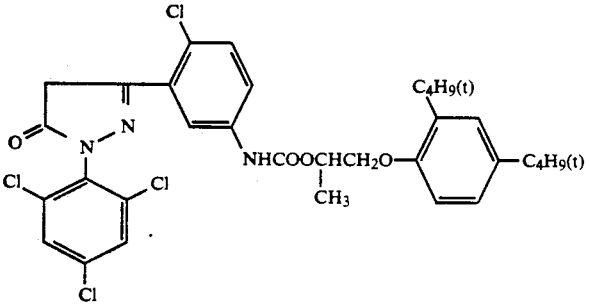

-continued

[M-68]

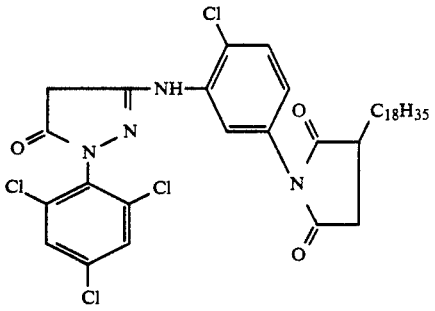

[M-69]

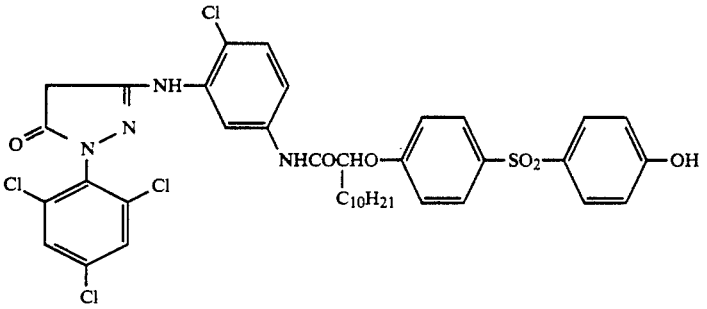

Other than the above representative specific examples, as a specific example of the compound represented by the above formula (M - I), there may be mentioned compounds disclosed in the right upper column on p. 18 to the right upper column on p. 32 of Japanese Unexamined Patent Publication No. 166339/1987.

As the compound represented by the above formula (M - XI), there may be mentioned, for example, compounds disclosed in U.S. Pat. Nos. 2,600,788, 3,061,432, 3,062,653, 3,127,269, 3,311,476, 3,152,896, 3,419,391 and 3,519,429.

As a cyan coupler to be used in the light-sensitive silver halide photographic material according to the present invention, a coupler represented by the following formula (C - I) may be mentioned.

(C-1)

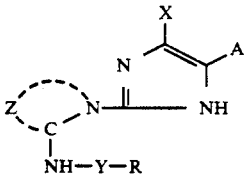

wherein A represents an organic group; X represents a hydrogen atom or a group eliminatable by reaction with an oxidized product of a color developing agent; Z represents a residue which can form a 5- or 6-membered heterocyclic group; Y represents a joint portion; and R represents a hydrogen atom or an organic group.

The cyan coupler represented by the formula (C - I) is described in more detail.

In the formula, the organic group represented by A may include an alkyl group, an aryl group, a heterocyclic group, —NHCOR', —NHSO$_2$R', —NHCONHR', —NHCOOR', and an alkyl group, an aryl group or a heterocyclic group which is bonded through an oxygen atom, a nitrogen atom or a sulfur atom. Here, R' represents a hydrogen atom, an alkyl group and an aryl group.

These groups may have a substituent group.

As a preferred example of A, there may be mentioned an aryl group and a heterocyclic group; the aryl group, a phenyl group and a naphthyl group; and the heterocyclic group, a thienyl group, a furyl group, a pyrolyl group, a pyrazolyl group, a pyridyl group and an isoxazolyl group.

As a more preferred example of A, there may be mentioned a phenyl group having a group which can form a hydrogen bonding such as an amide group, a sulfonamide group, a carbamoyl group and a sulfamoyl group at an ortho position.

As the group represented by X, which can be eliminated by reaction with an oxidized product of a color developing agent, there may be mentioned, for example, a halogen atom (chlorine, bromine and fluorine) and each group of hydroxyl, alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, mercapto, arylthio, heterocyclic thio, alkoxycarbonylthio, acylamino, substituted amino, nitrogen-containing hetero ring which is bonded by N atom, sulfonamide, alkyloxycarbonylamino, aryloxycarbonylamino and carboxyl, preferably a halogen atom, particularly preferably a chlorine atom.

As the 5-membered or 6-membered heterocyclic group represented by

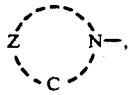

there may be mentioned, for example, a pyrrolyl group, an imidazolyl group, a pyrazolyl group, a pyrrolydinyl group, an imidazolydinyl group, a pyrazolidinyl group, a piperazinyl group, a morpholinyl group and a thiazolidinyl group.

These hetero rings can have a substituent group other than —NH—Y—R.

Y represents a mere bond atom or a divalent linking group such as —CO—, —COO—, —$SO_2$— and —CONH—.

R represents a hydrogen atom and an organic group such as an alkyl group, an aryl group and a heterocyclic group. When R is not a hydrogen atom, it may have a substituent group.

In the following, representative specific examples of the cyan coupler to be used in the present invention are shown, but the present invention is not limited to these.

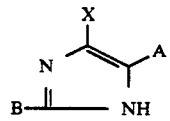

| NO. | X | A | B |
|---|---|---|---|
| C-1 | —Cl | 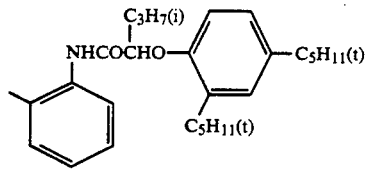 | 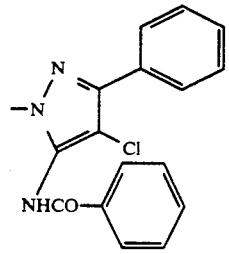 |
| C-2 | —Cl | 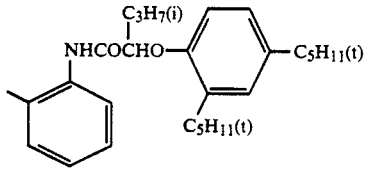 | 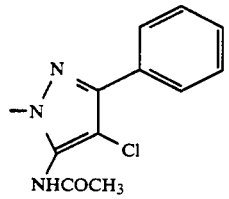 |
| C-3 | —$SCH_2CH_2COOH$ | 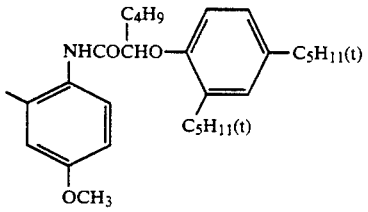 | 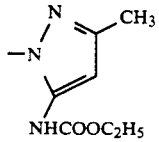 |
| C-4 | —$SCH_2CH_2COOH$ | 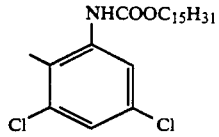 | 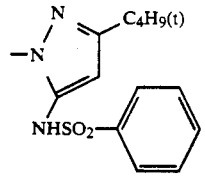 |
| C-5 | —Cl | 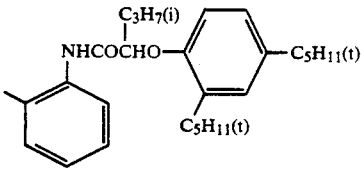 | 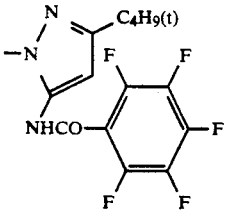 |
| C-6 | —Cl | 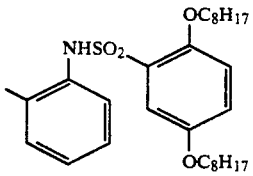 | 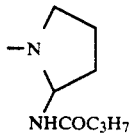 |

-continued
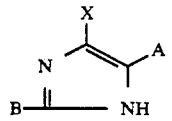
| NO. | X | A | B |
|---|---|---|---|
| C-7 | —Cl | 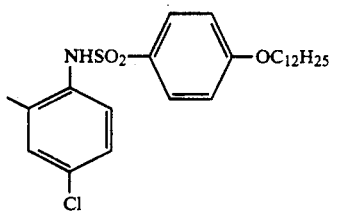 | 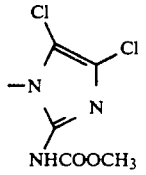 |
| C-8 | —Cl | 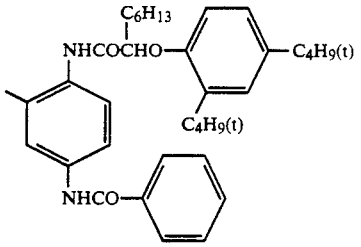 | 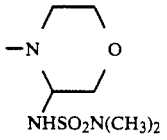 |
| C-9 | —Cl | 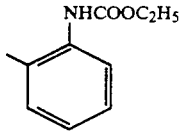 | 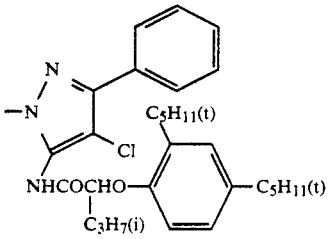 |
| C-10 | —Cl | 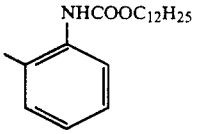 | 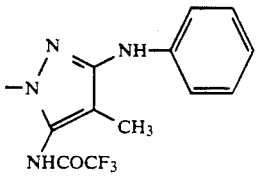 |
| C-11 | —Cl | —$C_8H_{17}$(t) | 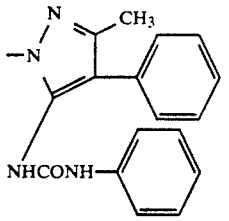 |
| C-12 | —H | 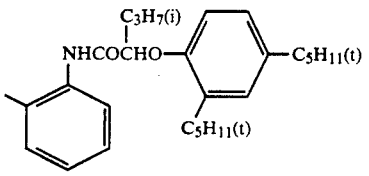 | 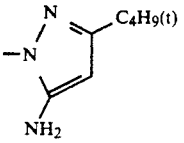 |

-continued
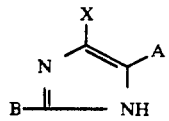
| NO. | X | A | B |
|---|---|---|---|
| C-13 | —Cl | 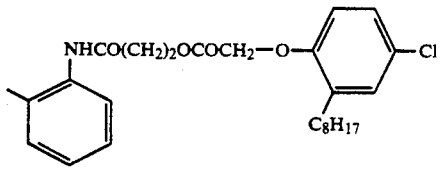 | 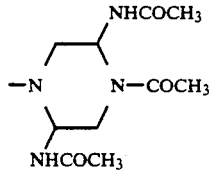 |
| C-14 | —Cl | 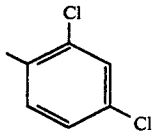 | 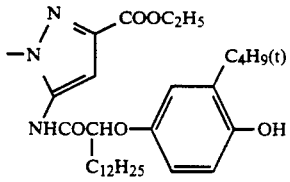 |
| C-15 | 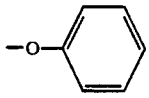 | 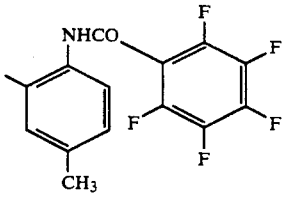 | 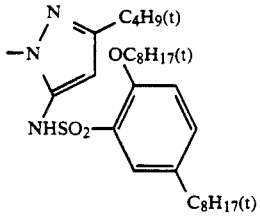 |
| C-16 | 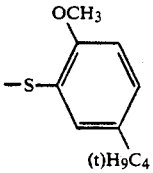 | 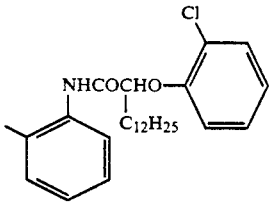 | 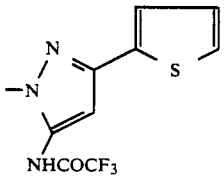 |
| C-17 | —Cl | 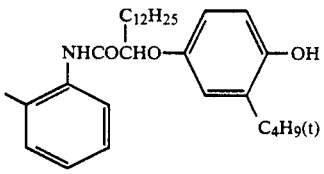 | 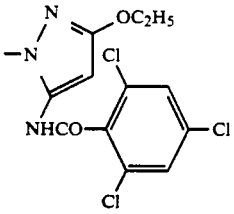 |
| C-18 | —Cl | 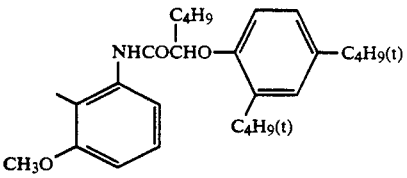 | 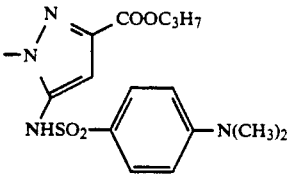 |
| C-19 | —Cl | 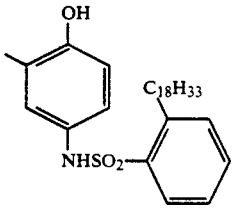 | 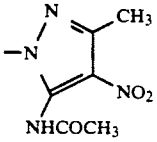 |

-continued

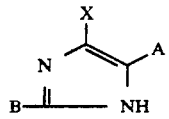

| NO. | X | A | B |
|---|---|---|---|
| C-20 | —Cl | 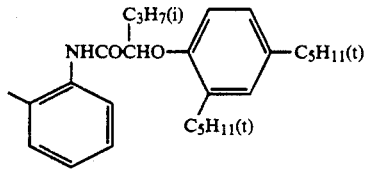 | 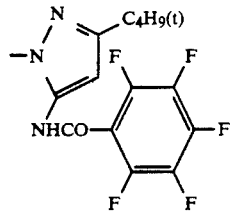 |
| C-21 | —Cl | 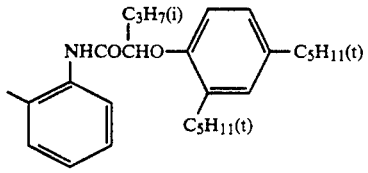 | 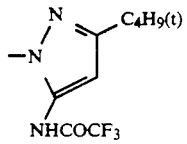 |
| C-22 | —Cl | 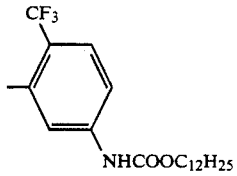 | 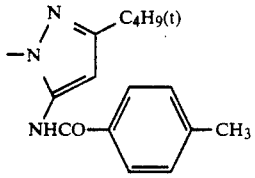 |
| C-23 | —Cl | 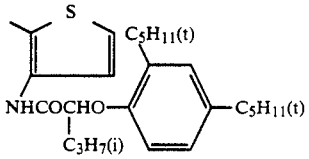 | 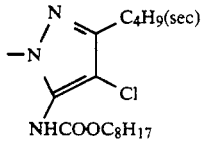 |
| C-24 | —Cl | 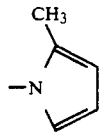 | 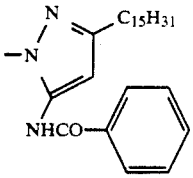 |
| C-25 | —Cl | 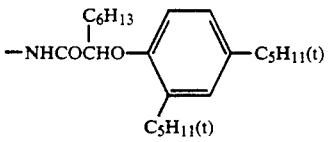 | 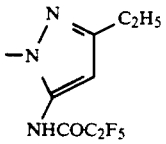 |

As the cyan color forming coupler to be used in the light-sensitive silver halide photographic material according to the present invention, a plural number of couplers may be used in combination. However, it is advantageous to use a coupler having $\Delta E_{max}$ of 70 or more. As the specific examples of a coupler which does not satisfy the above conditions alone but may be advantageously used in combination, the following compounds may be mentioned.

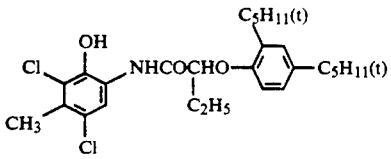

CC-1

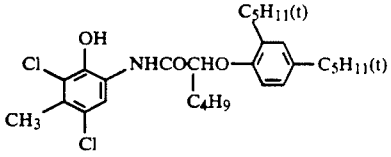

CC-2

-continued

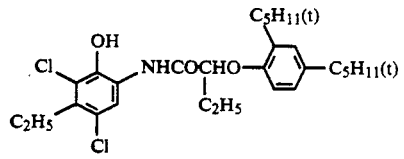

CC-3

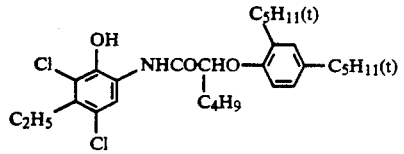

CC-4

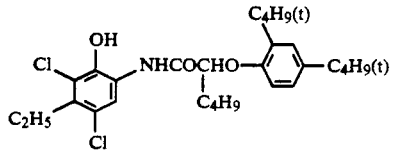

CC-5

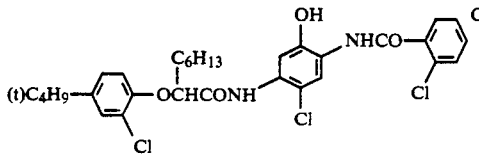

CC-6

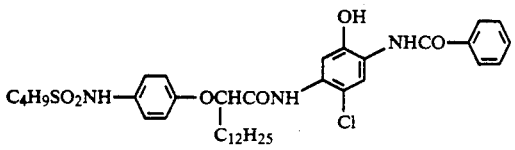

CC-7

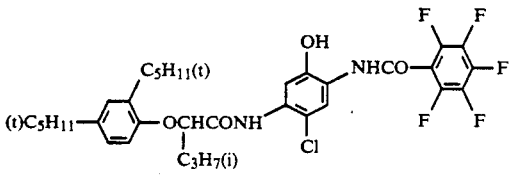

CC-8

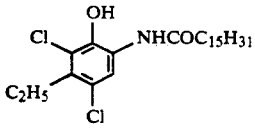

CC-9

The amount of the above yellow coupler to be added is preferably $2\times10^{-3}$ to $5\times10^{-1}$ mole, more preferably $1\times10^{-2}$ to $5\times10^{-1}$ mole per mole of silver halide.

The amount of the above magenta coupler to be added is preferably $1\times10^{-3}$ to 2 mole, more preferably $1\times10^{-2}$ to 1 mole per mole of silver halide.

Further, the amount of the above cyan coupler to be added is preferably $1\times10^{-3}$ to 1 mole, more preferably $1\times10^{-2}$ to $5\times10^{-1}$ mole per mole of silver halide.

The compounds such as dye-forming couplers of the light-sensitive silver halide photographic material of the present invention are generally dissolved in a high boiling point organic solvent having a boiling point of about 150° C. or higher or a water-insoluble polymer, if necessary, in combination with a low boiling point and/or water-soluble organic solvent, and dispersed by emulsification in a hydrophilic binder such as an aqueous gelatin solution by using a surfactant, and thereafter added in a desired hydrophilic colloid layer. A step of removing a dispersion or removing a low boiling point organic solvent simultaneously with a dispersion may be employed.

The high boiling point organic solvent is preferably a compound having a dielectric constant of 6.5 or less, for example, esters such as phthalate and phosphate, organic amides, ketones and hydrocarbon compounds having a dielectric constant of 6.5 or less, more preferably a high boiling point organic solvent having a dielectric constant of 6.5 or less and 1.9 or more and having a steam pressure at 100° C. of 0.5 mmHg or less. Among these solvents, phthalates or phosphates are more preferred. Most preferred is dialkyl phthalate having an alkyl group having 9 or more carbon atoms. Further, the high boiling point organic solvent may comprise a mixture of two or more kinds.

The dielectric constant refers to a dielectric constant at 30° C.

These high boiling point organic solvents are used generally at a rate of 0 to 400% by weight based on a coupler, preferably 10 to 100% by weight based on a coupler.

The light-sensitive silver halide photographic material to be used in the present invention may include, for example, a color film for display and a color printing paper. However, when a color printing paper provided to direct observation is used, the effect of the present invention can be exhibited particularly favorably.

In the present invention, silver bromide, silver iodobromide, silver iodochloride, silver chlorobromide and silver chloride which are generally used in a silver halide emulsion can be used as desired.

The silver halide emulsion to be used in the present invention is chemically sensitized according to the sulfur sensitization method, the selenium sensitization method, the reduction sensitization method and the noble metal sensitization method.

The silver halide emulsion to be used in the present invention can be optically sensitized to a desired wavelength region by using a dye which is known as a sensitizing dye in the field of photography.

Further, in the present invention, conventionally known binder (or protective colloid) materials, hardeners, UV absorbers, water-soluble dyes, lubricants, matte agents or surfactants can be used.

The photographic emulsion layers and other hydrophilic colloid layers of the light-sensitive silver halide photographic material of the present invention can be hardened by crosslinking binder (or protective colloid) molecules and using a hardener which enhances film strength singly or in combination. The hardener is desirably added to such an extent that the hardener is not required to be added in a processing solution and in an amount enough to make the light-sensitive material hardened, but the hardener can be added in a processing solution.

In the hydrophilic colloid layers such as a protective layer and an intermediate layer of the light-sensitive silver halide photographic material of the present invention, an UV absorber may be contained for preventing fog generated by discharge caused by static charge of the light-sensitive material by friction and preventing deterioration of images by UV lights.

In the light-sensitive silver halide photographic material of the present invention, auxiliary layers such as a filter layer, an antihalation layer and/or an antiirradiation layer can be provided. In these layers and/or the emulsion layers, a dye which is flown out from the light-sensitive color material or bleached during development processing may be contained.

In the present invention, in addition to conventional supports generally used, a thin reflective support with a thickness of 120 to 160 μm can be also used.

When the light-sensitive photographic material using the silver halide emulsion of the present invention is coated, a thickener may be used for increasing coatability. As a coating method, an extrusion coating and a curtain coating by which two or more layers can be coated simultaneously are particularly useful.

In the present invention, various conventional processing method used widely in color photographic processes can be used.

EXAMPLES

The present invention is described in detail by referring to Examples, but the present invention is not limited by these Examples.

EXAMPLE 1

On a paper support having one surface laminated with polyethylene and the other surface (a surface on which layers shown below are coated) laminated with polyethylene containing titanium oxide, the respective layers having the constitutions shown below were provided by coating to prepare a multi-layer light-sensitive silver halide color photographic material sample. The coating solutions were prepared as shown below.

First Layer Coating Solution

In 6.67 g of a high boiling point organic solvent (DNP), 26.7 g of a yellow coupler (Y-1), 10.0 g of a dye image stabilizer (ST-1), 6.67 g of (ST-2) and 0.67 g of an anti-staining agent (HQ-1) were dissolved with addition of 60 ml of ethyl acetate, and the solution was dispersed by emulsification in 220 ml of a 10% aqueous gelatin solution containing 7 ml of a 20% surfactant (SU-1) by means of an ultrasonic homogenizer to prepare a yellow coupler dispersion. This dispersion was mixed with a blue-sensitive silver halide emulsion (containing 10 g of silver) prepared under the following conditions to prepare a first layer coating solution.

The second layer to seventh layer coating solutions were prepared in the same manner as in the above first layer coating solution.

In Table 1, constitutions of the above layers are shown.

TABLE 1

| Layer | Constitution | Amount added ($g/m^2$) |
|---|---|---|
| Seventh layer (protective layer) | Gelatin | 1.0 |
| Sixth layer (UV absorbing layer) | Gelatin | 0.4 |
| | UV absorber (UV-1) | 0.10 |
| | UV absorber (UV-2) | 0.04 |
| | UV absorber (UV-3) | 0.16 |
| | Antistaining agent (HQ-1) | 0.01 |
| | DNP | 0.2 |
| | PVP | 0.03 |
| | Antiirradiation dye (AI-2) | 0.02 |
| Fifth layer (red-sensitive layer) | Gelatin | 1.30 |
| | Red-sensitive silver chlorobromide emulsion (EmC) calculated on silver | 0.21 |
| | Cyan coupler (C-1) | 0.37 |
| | Dye image stabilizer (ST-1) | 0.20 |
| | Antistaining agent (HQ-1) | 0.01 |
| | HBS-1 | 0.20 |
| | DOP | 0.20 |

TABLE 1-continued

| Layer | Constitution | Amount added ($g/m^2$) |
|---|---|---|
| Fourth layer (UV-absorbing layer | Gelatin | 0.94 |
| | UV absorber (UV-1) | 0.28 |
| | UV absorber (UV-2) | 0.09 |
| | UV absorber (UV-3) | 0.38 |
| | Antistaining agent (HQ-1) | 0.03 |
| | DNP | 0.40 |
| Third layer (green-sensitive layer) | Gelatin | 1.40 |
| | Green-sensitive silver chlorobromide emulsion (EmB) calculated on silver | 0.17 |
| | Magenta coupler (M-23) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Antiirradiation dye (AI-1) | 0.01 |
| Second layer (intermediate layer) | Gelatin | 1.20 |
| | Antistaining agent (HQ-2) | 0.12 |
| | DIDP | 0.15 |
| First layer (blue-sensitive layer) | Gelatin | 1.20 |
| | Blue-sensitive silver chlorobromide emulsion (EmA) calculated on sivler | 0.26 |
| | Yellow coupler (Y-1) | 0.80 |
| | Dye image stabilizer (ST-1) | 0.30 |
| | Dye image stabilizer (ST-2) | 0.20 |
| | Antistaining agent (HQ-1) | 0.02 |
| | Antiirradiation dye (AI-3) | 0.01 |
| | DNP | 0.20 |
| Support | Polyethylene-laminated paper | |

Note: The low boiling point organic solvent used at the time of preparing the first layer has been evaporated and does not remain in the light-sensitive material.

ST-1

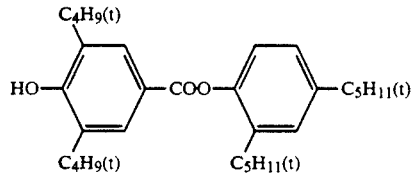

ST-2

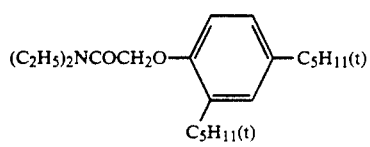

ST-3

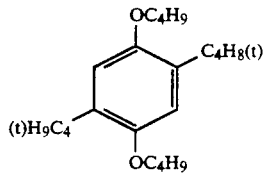

ST-4

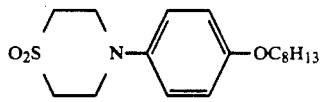

ST-5

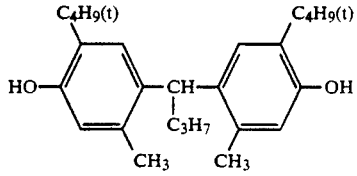

-continued
UV-1
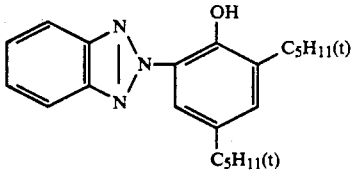
UV-2
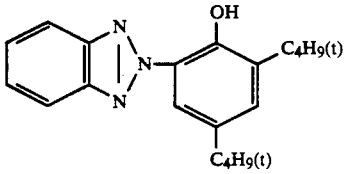
-continued
UV-3
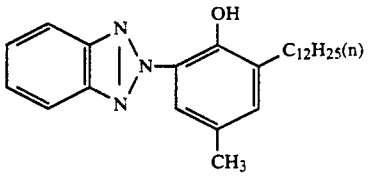
| | |
|---|---|
| DOP: dioctyl phthalate | DNP: dinonyl phthalate |
| DIDP: diisodecyl phthalate | PVP: polyvinyl pyrrolidone |
| TOP: trioctyl phosphate | TCP: tricresyl phosphate |
HBS-1
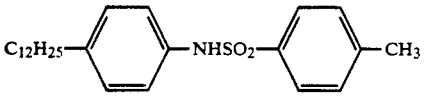
HQ-1
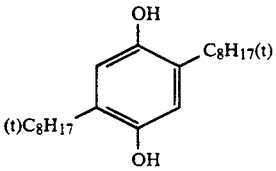
HQ-2
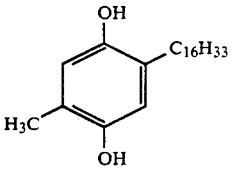
SU-1
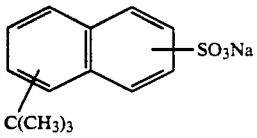
AI-1
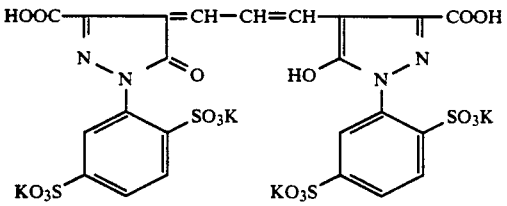
AI-2
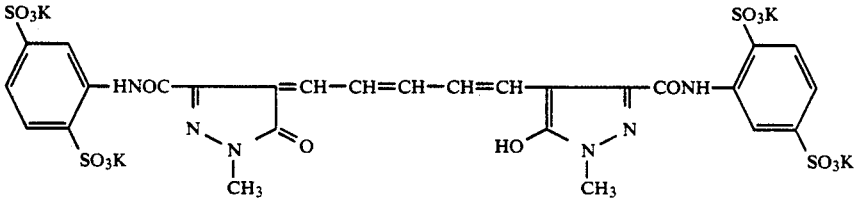

-continued

AI-3

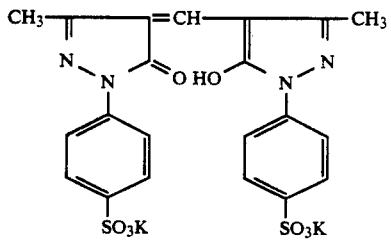

As a hardener, the following H-1 was used.

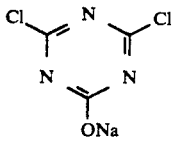

Preparation Method of Blue-sensitive Silver Halide Emulsion to 1,000 ml of a 2% aqueous gelatin solution maintained at 40° C., the following (A solution) and (B solution) were added simultaneously over 30 minutes under controlling pAg=6.5 and pH=3.0, and further the following (C solution) and (D solution) were added simultaneously over 180 minutes under controlling pAg=7.3 and pH=5.5.

During this addition, the pAg was controlled according to a method disclosed in Japanese Unexamined Patent Publication No. 45437/1984, and the pH was controlled by using an aqueous solution of sulfuric acid or sodium hydroxide.

| | |
|---|---|
| (A solution) | |
| Sodium chloride | 3.42 g |
| Potassium bromide | 0.03 g |
| made up to 200 ml with addition of water. | |
| (B solution) | |
| Silver nitrate | 10 g |
| made up to 200 ml with addition of water. | |
| (C solution) | |
| Sodium chloride | 102.7 g |
| Potassium bromide | 1.0 g |
| made up to 600 ml with addition of water. | |
| (D solution) | |
| Silver nitrate | 300 g |
| made up to 600 ml with addition of water. | |

After completion of the addition, desalting was effected by using a 5% aqueous solution of Demol N (trade name) manufactured by Kao Atlas K.K. and a 20% aqueous solution of magnesium sulfate, and then the solution was mixed with an aqueous gelatin solution to obtain a monodispersed cubic emulsion EMP-1 having an average grain size of 0.85 μm, variation coefficient ($\sigma/\bar{r}$) of 0.07 and a silver chloride content of 99.5 mole %.

By using the following compounds, the above emulsion EMP-1 was chemically ripened at 50° C. for 90 minutes to obtain a blue-sensitive silver halide emulsion (EmA).

| | |
|---|---|
| Sodium thiosulfate | 0.8 mg/mole of AgX |
| Chloroauric acid | 0.5 mg/mole of AgX |
| Stabilizer SB-5 | $6 \times 10^{-4}$ mole/mole of AgX |
| Sensitizing dye D-1 | $5 \times 10^{-4}$ mole/mole of AgX |

Preparation Method of Green-sensitive Silver Halide Emulsion

The procedures were carried out in the same manner as in EMP-1 except for changing the addition time of (A solution) and (B solution) and the addition time of (C solution) and (D solution) to obtain a monodispersed cubic emulsion EMP-2 having an average grain size of 0.43 μm, variation coefficient ($\sigma/\bar{r}$) of 0.08 and a silver chloride content of 99.5 mole %.

By using the following compounds, the emulsion EMP-2 was chemically ripened at 55° C. for 120 minutes to obtain a green-sensitive silver halide emulsion (EmB).

| | |
|---|---|
| Sodium thiosulfate | 1.5 mg/mole of AgX |
| Chloroauric acid | 1.0 mg/mole of AgX |
| Stabilizer SB-5 | $6 \times 10^{-4}$ mole/mole of AgX |
| Sensitizing dye D-2 | $4 \times 10^{-4}$ mole/mole of AgX |

Preparation Method of Red-sensitive Silver Halide Emulsion

The procedures were carried out in the same manner as in EMP-1 except for changing the addition time of (A solution) and (B solution) and the addition time of (C solution) and (D solution) to obtain a monodispersed cubic emulsion EMP-3 having an average grain size of 0.50 μm, variation coefficient ($\sigma/\bar{r}$) of 0.08 and a silver chloride content of 99.5 mole %.

By using the following compounds, the emulsion EMP-3 was chemically ripened at 60° C. for 90 minutes to obtain a red-sensitive silver halide emulsion (EmC).

| | |
|---|---|
| Sodium thiosulfate | 1.8 mg/mole of AgX |
| Chloroauric acid | 2.0 mg/mole of AgX |
| Stabilizer SB-5 | $6 \times 10^{-4}$ mole/mole of AgX |
| Sensitizing dye D-3 | $1.0 \times 10^{-4}$ mole/mole of AgX |

D-1

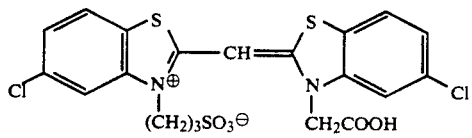

-continued

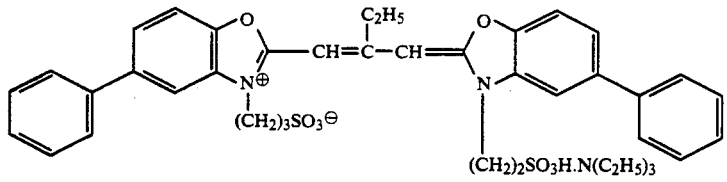

D-2

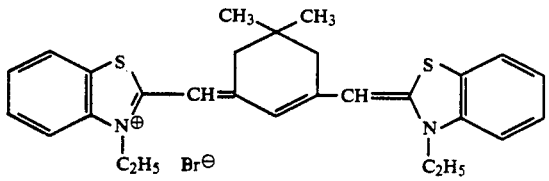

D-3

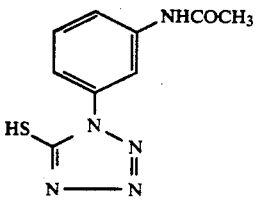

SB-5

By the above procedures, a light-sensitive silver halide color photographic material No. 101 was prepared.

This sample was subjected to separation exposure by various exposure amounts by using Wratten 29 and 99 (trade name, manufactured by Eastman Kodak Co.) filters and a combination of interference filters KL-46 and L-42 (trade names, manufactured by Toshiba Glass K.K.), and respective single color patches of cyan, magenta and yellow were prepared according to the following processing method. Further, an unexposed sample was processed in the same manner to prepare a white patch.

| Processing step | Temperature | Time |
|---|---|---|
| Color Development | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

| Color developing solution | |
|---|---|
| Pure water | 800 ml |
| Triethanolamine | 10 g |
| N,N-Diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-diphosphonate | 1.0 g |
| N-ethyl-N-β-methanesulfonamidoethyl-3-methyl-4-aminoanilinesulfonic acid | 4.5 g |
| Fluorescent brightener (4,4'-diamino-stylbenzisulfonic acid derivative) | 1.0 g |
| Potassium carbonate | 27 g |
| made up to 1 liter in total with addition of water, and adjusted to pH = 10.10. | |
| **Bleach-fixing solution** | |
| Ferric ammonium ethylenediaminetetra-acetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| made up to 1 liter in total with addition of water, and adjusted to pH = 5.7 with potassium carbonate or glacial acetic acid. | |
| **Stabilizing solution** | |
| 5-Chloro-2-methyl-4-isothiazolin-3-on | 1.0 g |

-continued

| | |
|---|---|
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% aqueous solution) | 3.0 g |
| Fluorescent brightener (4,4'-diamino-stylbenzisulfonic acid derivative) | 1.5 g |
| made up to 1 liter in total with addition of water, and adjusted to pH = 7.0 with sulfuric acid or potassium hydroxide. | |

By using a color analyzer Model 607 (trade name, manufactured by Hitachi Seisakusho K.K.), spectral absorption of each sample was measured, and based on the values obtained, L*, a* and b* were calculated according to a method of JIS Z-8729. Subsequently, according a method of JIS Z-8730, color difference ΔE between each sample and a white patch was calculated. The relationship between the density measured by PDA-65 densitometer (trade name, manufactured by Konica Corporation) and ΔE is shown in FIG. 1.

Next, a light-sensitive silver halide color photographic materials was prepared by changing couplers variously and according to the above method, and $\Delta E_{max}$ was measured. However, the amounts of couplers were basically set to become equimolar, and the amounts of silver halide and couplers were so changed that substantially the same tone could be obtained.

The maximum values ($\Delta E_{max}$ of ΔE's of the respective couplers obtained by using this sample are shown in Table 2.

TABLE 2

| Coupler | $\Delta E_{max}$ |
|---|---|
| Y-1 | 89.7 |
| Y-5 | 89.0 |
| Y-6 | 88.5 |
| Y-8 | 90.6 |
| Y-9 | 91.2 |
| M-63 | 81.2 |
| M-68 | 79.4 |
| M-69 | 80.3 |
| M-23 | 93.9 |
| M-61 | 94.3 |
| CC-1 | 65.0 |

TABLE 2-continued

| Coupler | $\Delta E_{max}$ |
|---|---|
| CC-3 | 67.1 |
| CC-8 | 63.0 |
| CC-9 | 64.1 |
| CC-1/CC-8 | 63.5 |
| CC-3/CC-8 | 64.0 |
| C-1 | 75.3 |
| C-15 | 72.9 |

In the examples using a combination of cyan couplers, the couplers were used in equimolar amounts.

unteers, and sharpness of the images was evaluated. For Scene 1, red saturation phenomenon was also evaluated.

(Scene 1) Portrait of woman wearing red sweater (Scene 2) Group photograph (Scene 3) Landscape of mountains (Scene 4) Landscape of amusement parks The evaluation was made by observing the respective prints. In respect of red saturation phenomenon and sharpness of the images, evaluations were made by using 3 ranks of "Excellent" (3 points), "Average" (2 points) and "Inferior" (1 point), and average values were calculated.

The results are shown in Table 3.

TABLE 3

| Sample No. | Yellow coupler | Magenta coupler | Cyan coupler | Ratio of $\Delta E_{max}$ of cyan (%) | $\Delta E_{max}$ of cyan | Red saturation phenomenon in Scene 1 | Sharpness of images Scene 1 | Scene 2 | Scene 3 | Scene 4 | Remarks |
|---|---|---|---|---|---|---|---|---|---|---|---|
| 101 | Y-1 | M-23 | CC-3 | 74 | 67.1 | 1.5 | 1.9 | 1.8 | 2.3 | 2.4 | Comparative |
| 102 | Y-5 | M-23 | CC-3 | 75 | 67.1 | 1.6 | 2.1 | 1.7 | 2.3 | 2.6 | Comparative |
| 103 | Y-8 | M-23 | CC-3 | 72 | 67.1 | 1.5 | 1.8 | 1.8 | 2.2 | 2.5 | Comparative |
| 104 | Y-8 | M-69 | CC-3 | 81 | 67.1 | 2.0 | 2.2 | 2.0 | 2.4 | 2.1 | Comparative |
| 105 | Y-8 | M-61 | CC-3 | 72 | 67.1 | 1.4 | 2.1 | 1.8 | 2.5 | 2.3 | Comparative |
| 106 | Y-8 | M-23 | CC-8 | 69 | 63.0 | 1.5 | 1.8 | 1.7 | 2.6 | 2.6 | Comparative |
| 107 | Y-8 | M-23 | CC-9 | 71 | 64.1 | 1.5 | 1.8 | 1.8 | 2.6 | 2.5 | Comparative |
| 108 | Y-8 | M-23 | C-1 | 83 | 75.3 | 2.7 | 2.7 | 2.8 | 2.8 | 2.6 | Present invention |
| 109 | Y-8 | M-23 | C-15 | 80 | 72.9 | 2.6 | 2.6 | 2.9 | 2.7 | 2.7 | Present invention |
| 110 | Y-8 | M-69 | C-1 | 94 | 75.3 | 2.5 | 2.7 | 2.9 | 2.4 | 2.2 | Present invention |
| 111 | Y-8 | M-69 | C-15 | 91 | 72.9 | 2.4 | 2.5 | 2.8 | 2.5 | 2.4 | Present invention |
| 112 | Y-9 | M-68 | CC-3 | 82 | 67.1 | 1.9 | 2.2 | 2.0 | 2.2 | 2.2 | Comparative |
| 113 | Y-9 | M-69 | C-1 | 94 | 75.3 | 2.4 | 2.7 | 2.7 | 2.4 | 2.4 | Present invention |
| 114 | Y-9 | M-61 | CC-3/CC-8 | 70 | 64.0 | 1.5 | 1.4 | 1.8 | 2.2 | 2.6 | Comparative |
| 115 | Y-2 | M-68 | CC-1/CC-8 | 80 | 63.5 | 2.1 | 2.2 | 2.3 | 2.3 | 2.4 | Comparative |
| 116 | Y-5 | M-23 | CC-1/CC-8 | 72 | 63.5 | 1.6 | 1.5 | 1.9 | 2.4 | 2.3 | Comparative |
| 117 | Y-8 | M-23 | CC-A | 68.8 | 62.3 | 1.9 | 2.0 | 2.0 | 1.8 | 1.9 | Comparative |
| 118 | Y-8 | M-23 | CC-B | 72.8 | 66.0 | 2.1 | 2.2 | 2.4 | 2.3 | 2.3 | Comparative |
| 119 | Y-8 | M-23 | CC-C | 72.1 | 65.3 | 2.0 | 2.2 | 2.3 | 2.2 | 2.1 | Comparative |

CC-A

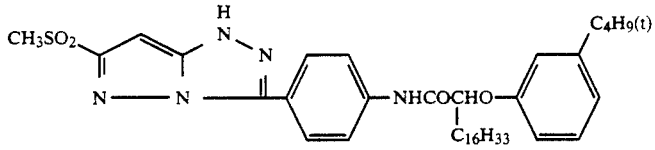

ΔEmax = 62.3

CC-B

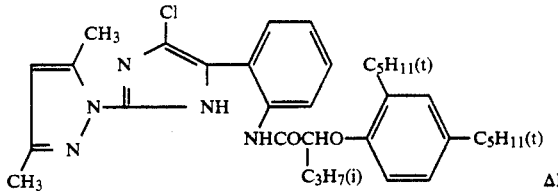

ΔEmax = 66.0

CC-C

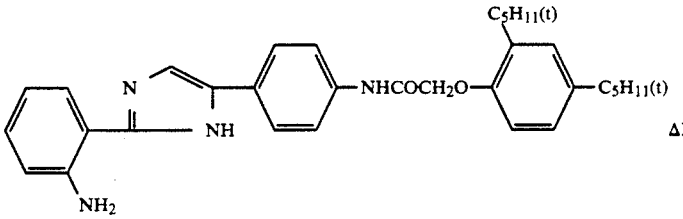

ΔEmax = 65.3

EXAMPLE 2

By using the respective samples prepared in Example 1 and Samples No. 117 and No. 118 shown in Table 3, various scenes were photographed, and color prints were prepared. These prints were presented to 10 vol- As shown in Table 3, it can be understood that in the samples in which the rate of $\Delta E_{max}$ of cyan relative to yellow or magenta exceeds 80% and further $\Delta E_{max}$ of cyan exceeds 70, red saturation phenomenon is cancelled and sharpness of images is improved. As to the sharpness of images, impression differs depending on the scene, and improvement degree is large in Scenes 1 and 2.

In Scene 1, the light and shade pattern of stitches of the sweater was printed clearly, and red saturation phenomenon was prevented. In Samples No. 108 and No. 109 among the samples, red was printed brightly and vividly, and the effect was conspicuous. It is a preferred embodiment of the present invention to use a pyrazoloazol type coupler as a magenta coupler.

In Scene 2, the features and contours of individual faces were printed distinctly, thereby reaching a conclusion that sharpness of images could be obtained.

EXAMPLE 3

In Samples No. 101 and No. 102 in Example 1, the amounts of the antiirradiation dyes (AI-1, 2 and 3) added were increased by 1.5 times to prepare Samples No. 301 and No. 302. According to a conventional method, sensitometry was carried out to obtain a sensitivity of the red-sensitive emulsion, and a red density of unexposed portions was measured by TR 310 densitometer (trade name, manufactured by X Light Co.). The sensitivities were represented in a relative sensitivity when the sensitivity of Sample No 101 was defined as 100. The densities at unexposed portions were represented in a relative value based on the density of Sample No. 101. In the same manner as in Example 2, red saturation phenomenon and sharpness of images were evaluated. The results are shown in Table 4.

TABLE 4

| Sample No. | Sensitivity | Density at unexposed portions | Red saturation phenomenon in Scene 1 | Sharpness of images Scene 1 | Scene 2 | Scene 3 | Scene 4 |
|---|---|---|---|---|---|---|---|
| 101 | 100 | 0.000 | 1.5 | 1.9 | 1.8 | 2.3 | 2.4 |
| 301 | 52 | 0.004 | 2.3 | 2.4 | 2.0 | 2.3 | 2.4 |
| 102 | 98 | 0.001 | 1.6 | 2.1 | 1.7 | 2.3 | 2.6 |
| 302 | 48 | 0.004 | 2.4 | 2.3 | 2.0 | 2.4 | 2.4 |
| 108 | 100 | 0.000 | 2.7 | 2.7 | 2.8 | 2.8 | 2.6 |

As clearly shown in Table 4, by increasing the amount of the antiirradiation dye, slight elevation of the density at unexposed portions was observed, and at the same time, the sensitivity was lowered to a great extent. This lowering in sensitivity was a serious problem in steps of producing prints.

It was recognized that increase of the amount of the anti-irradiation dye had effect on both prevention of red saturation and improvement of sharpness of images. However, depending on the scene, sharpness of images was not improved sufficiently. The advantage of the present invention over techniques for improving sharpness by using anti-irradiation dyes is apparent

EXAMPLE 4

In the method for preparing Sample No. 101 in Example 1, a cyan coupler C-3 in an amount of 5 mole % relative to the magenta coupler was added in the third layer, and the same amount of a cyan coupler is decreased from the cyan coupler in the fifth layer.to prepare Sample No. 401.

Next, Sample No. 402 was prepared according to the same method for preparing Sample No. 101 in Example 1 except for preparing a red-sensitive emulsion by adding a sensitizing dye D-2 in an amount of $5\times10^{-5}$ mole/mole of AgX at the time of preparing a red-sensitive emulsion of the fifth layer.

In the same manner as in Example 2, red saturation phenomenon and sharpness of images were evaluated.

The results are shown in Table 5.

TABLE 5

| Sample No. | Red saturation phenomenon in Scene 1 | Sharpness of images Scene 1 | Scene 2 | Scene 3 | Scene 4 | Remarks |
|---|---|---|---|---|---|---|
| 101 | 1.5 | 1.9 | 1.8 | 2.3 | 2.4 | Comparative |
| 401 | 2.2 | 2.1 | 1.8 | 2.4 | 2.2 | Comparative |
| 402 | 2.3 | 2.1 | 1.9 | 2.3 | 2.1 | Comparative |
| 108 | 2.7 | 2.7 | 2.8 | 2.8 | 2.6 | This invention |

As clearly shown in Table 5, in the techniques for forming quantized continuous tone by spectral sensitivities and by mixing couplers having different hues, sharpness of images could not be obtained, and reproduced red became slightly dark color tinged with blue.

EXAMPLE 5

In Samples No. 101 and No. 108 in Example 1, the amounts of the silver halide emulsion and magenta coupler dispersion in the third layer of the green-sensitive layer were changed and tone was changed to prepare Samples No. 501, No. 502 and No. 503 (corresponding to Sample No. 101), and Samples No. 504, No. 505 and No. 506 (corresponding to Sample No. 108). The tone was so controlled that neutral gray color could be reproduced also in the red-sensitive and blue-sensitive emulsion layers. According to the method described above, $\Delta E_{max}$ of magenta was evaluated, and at the same time, Sensitometry was carried out. The tones were represented in a relative value when the tones of Samples No. 101 and No. 108 were defined as 100, respectively.

The results are shown in Table 6.

TABLE 6

| Sample No. | Tone (%) | $\Delta E_{max}$ of magenta | $\Delta E_{max}$ of cyan | Ratio of $\Delta E_{max}$ (%) | Red saturation phenomenon in Scene 1 | Sharpness of images Scene 1 | Scene 2 | Scene 3 | Scene 4 |
|---|---|---|---|---|---|---|---|---|---|
| 101 | 100 | 93.9 | 67.1 | 74 | 1.5 | 1.9 | 1.8 | 2.3 | 2.4 |
| 501 | 90 | 90.0 | 63.8 | 75 | 1.4 | 1.8 | 1.6 | 2.1 | 2.0 |
| 502 | 80 | 83.8 | 62.9 | 77 | 1.3 | 1.5 | 1.5 | 1.7 | 1.8 |
| 503 | 70 | 76.0 | 58.9 | 82 | 1.3 | 1.3 | 1.3 | 1.3 | 1.4 |
| 108 | 100 | 93.9 | 75.3 | 83 | 2.7 | 2.7 | 2.8 | 2.8 | 2.6 |
| 504 | 90 | 90.0 | 71.4 | 84 | 2.5 | 2.7 | 2.6 | 2.5 | 2.6 |
| 505 | 80 | 83.8 | 70.3 | 86 | 2.4 | 2.5 | 2.4 | 2.6 | 2.5 |

TABLE 6-continued

| Sample No. | Tone (%) | $\Delta E_{max}$ of magenta | $\Delta E_{max}$ of cyan | Ratio of $\Delta E_{max}$ (%) | Red saturation phenomenon in Scene 1 | Sharpness of images Scene 1 | Scene 2 | Scene 3 | Scene 4 |
|---|---|---|---|---|---|---|---|---|---|
| 506 | 70 | 76.0 | 64:6 | 90 | 2.0 | 2.0 | 1.9 | 1.8 | 1.9 |

As clealy shown in Table 6, according to this method, lowering of the maximum density accompanied with contrast reduction cannot be avoided, and $\Delta E_{max}$ is also lowered. However, in the samples according to the present invention, influence of contrast reduction on sharpness of images is small, and therefore it can be understood that the present invention is a method useful for obtaining tone reproduction, prevention of red saturation phenomenon and improvement of sharpness of images all at the same time.

EXAMPLE 6

By combining yellow couplers Y-3, Y-4 and Y-7, magenta couplers M-63, M-64, M-65, M-66 and M-67 and cyan couplers C-1 and C-15, respectively, a light-sensitive silver halide color photographic material was prepared according to the method in Example 1.

When color negatives obtained by photographing various scenes by using Konica Color GXII 100 (trade name, manufactured by Konica Corporation) were printed on Samples No. 101 to No. 116 and the above light-sensitive color photographic material to prepare prints, it was confirmed that the effect of the present invention could be obtained by the light-sensitive silver halide color photographic material according to the present invention.

EXAMPLE 7

According to the method described below, a direct positive type Sample No. 701 was prepared.

Preparation of Emulsion EM-1

In an aqueous solution containing ossein gelatin of which a temperature was controlled at 55° C., an aqueous silver nitrate solution and an aqueous solution containing potassium bromide and sodium chloride (molar ratio of KBr:NaCl=40:60) were added simultaneously under vigorous stirring according to a control double jet method to obtain a cubic silver chlorobromide emulsion A having an average grain size of 0.3 μm. To the emulsion A used as a core grain, an aqueous silver nitrate solution and an aqueous sodium chloride solution were further added simultaneously while maintaining a temperature of 55° C. and pAg=6 according to a double jet method to obtain a cubic monodispersed core/shell emulsion EM-1 having an average grain size of 0.6 μm. (Its distribution width* was 8%.)

$$\text{Distribution width (\%)} = \frac{\text{Standard deviation of grain size}}{\text{Average grain size}} \times 100$$

Composition of Light-sensitive Layers

In the following, components and amounts coated represented in g/m² are shown. The amounts of silver halide are represented in a value calculated on silver.

| | |
|---|---|
| First layer (red-sensitive layer) | |
| Red-sensitive emulsion spectrally sensitized by adding red-sensitive sensitizing dyes (RD-1 and RD-2) to Emulsion EM-1 | 0.4 |
| Gelatin | 1.38 |
| Cyan coupler (C-1) | 0.37 |
| Image stabilizer (ST-1) | 0.22 |
| Solvent (DOP) | 0.33 |
| Second layer (intermediate layer) | |
| Gelatin | 0.75 |
| Color mixture preventive agent (HQ-1) | 0.06 |
| Solvent (DOP) | 0.07 |
| Third layer (green-sensitive layer) | |
| Green-sensitive emulsion spectrally sensitized by adding a green-sensitive sensitizing dye (D-2) to Emulsion EM-1 | 0.27 |
| Gelatin | 1.3 |
| Magenta coupler (M-23) | 0.35 |
| Image stabilizer (ST-3) | 0.20 |
| Solvent (DNP) | 0.32 |
| Fourth layer (intermediate layer) | |
| the same layer as the second layer | |
| Fifth layer (yellow filter layer) | |
| Gelatin | 0.42 |
| Yellow colloidal silver | 0.10 |
| UV absorber (UV-1) | 0.05 |
| UV absorber (UV-2) | 0.14 |
| Color mixture preventive agent (HQ-1) | 0.04 |
| Solvent (DNP) | 0.08 |
| Sixth layer (color mixture preventive layer) | |
| Gelatin | 0.40 |
| Color mixture preventive agent (HQ-1) | 0.03 |
| Solvent (DOP) | 0.04 |
| Seventh layer (blue-sensitive layer) | |
| Blue-sensitive emulsion spectrally sensitized by adding a blue-sensitive sensitizing dye (D-1) to Emulsion EM-1 | 0.50 |
| Gelatin | 1.35 |
| Yellow coupler (Y-1) | 0.8 |
| Image stabilizer (ST-1) | 0.30 |
| High boiling point water-insoluble organic solvent (DNP) | 0.20 |
| High boiling point water-soluble organic solvent (N,N-dimethylformamide) | 0.09 |
| Eighth layer (UV absorbing layer) | |
| Gelatin | 0.54 |
| UV absorber (UV-1) | 0.10 |
| UV absorber (UV-2) | 0.28 |
| Solvent (DNP) | 0.12 |
| Ninth layer (protective film) | |
| Gelatin | 0.12 |

RD-1

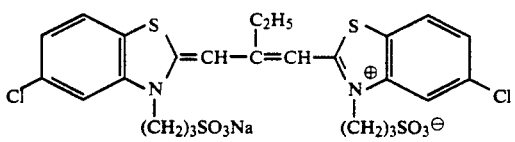

RD-2

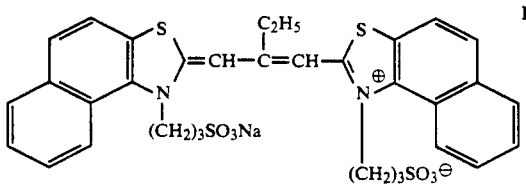

Next, in Samples No. 102 to No. 116 in Example 1, only couplers were changed to prepare corresponding Samples No. 702 to No. 716. These samples were subjected to exposure by various exposure amounts by using Latten 12, 32 and 44 (trade name, manufactured by Eastman Kodak Co.) filters to prepare respective single color patches. Further, a sample exposed by white lights was processed at the same time to prepare a white patch. When color difference between the color patches and the white patch was measured according to the same method as in Example 1, the same value as those in Example 1 were obtained.

By using these samples, copies of various color prints were made by a modified machine of Konica Color 7 (trade name, manufactured by Konica Corporation) according to the following processings, and as a result, it was confirmed that in Samples No. 708 to No. 711 and No. 713, the effect of the present invention could be obtained similarly as in Example 1.

| (Processing steps) | Time (sec) | Processing temperature |
|---|---|---|
| Immersion | 2 | 38° C. |
| Exposure | 5 | 38° C. (1 lux) |
| Development | 25 | 38° C. |
| Bleach-fixing | 45 | 35° C. |
| Stabilizing | 90 | 25 to 30° C. |
| Drying | 45 | 75 to 80° C. |

(Compositions of processing solutions)

| | |
|---|---|
| (Color developing solution) | |
| Benzyl alcohol | 10 g |
| Ethylene glycol | 8.55 g |
| Diethylene glycol | 50 g |
| $Ce_2(SO_4)_3$ | 0.015 g |
| Potassium sulfite | 2.5 g |
| Sodium bromide | 0.1 g |
| Sodium chloride | 2.5 g |
| Diethylhydroxylamine (85%) | 5.0 g |
| Sodium diethylenetriaminepentaacetate | 2.0 g |
| CD-3 | 7.0 g |
| Fluorescent brightener (4,4'-diaminostyl-benzisulfonic acid derivative) | 1.0 g |
| Potassium carbonate | 30 g |
| Potassium hydroxide | 2.0 g |
| made up to 1 liter in total with addition of water, and adjusted pH to 10.10 with potassium hydroxide or sulfuric acid. | |
| (Bleach-fixing solution) | |
| Ferric ammonium diethylenetriamine-pentaacetate | 90 g |
| Diethylenetriaminepentaacetic acid | 3 g |
| Ammonium thiosulfate (70% aqueous solution) | 180 ml |
| Ammonium sulfite (40% aqueous solution) | 27.5 ml |
| 3-Mercapto-1,2,4-triazole | 0.15 g |
| adjusted pH to 7.1 with potassium carbonate or glacial acetic acid, and made up to 1 liter in total with addition of water. | |
| (Stabilizing solution) | |
| Ortho.phenylphenol | 0.3 g |
| Potassium sulfite (50% aqueous solution) | 12 ml |
| Ethylene glycol | 10 g |
| 1-Hydroxyethylidene-1,1-diphosphonic acid | 2.5 g |
| Bismuth chloride | 0.2 g |
| Heptahydrate of zinc sulfate | 0.7 g |
| Ammonium hydroxide (28% aqueous solution) | 2.0 g |
| PVP (K-17) | 0.2 g |
| Fluorescent brightener (4,4'-diaminostyl-benzisulfonic acid derivative) | 2 g |
| made up to 1 liter in total with addition of water, and adjusted pH to 7.5 with ammonium hydroxide or sulfuric acid. | |

According to the present invention, cancelling of red saturation phenomenon and improvement of sharpness of images can be obtained, whereby features and contours of faces can be printed clearly. Further, in the present invention, there is neither problem nor inconvenience caused by (1) techniques for improving sharpness by using irradiation dyes, (2) techniques of forming quantized continuous tone by spectral sensitivities or by mixing couplers having different hues and (3) techniques of controlling tone so that neutral gray color can be reproduced.

We claim:

1. A light-sensitive silver halide color photographic material having a photographic constituent layer containing a yellow color-forming coupler, a magenta color-forming coupler and a cyan color-forming coupler on a reflective support, characterized in that when each coupler is color-formed independently, the ratio of the maximum value of the CIE 1976 L*a*b* color difference between a colored portion and a minimum density portion of cyan relative to the maximum value of the CIE 1976 L*a*b* color difference of either yellow or magenta, whichever value is smaller, is 80% or more, and $\Delta E_{max}$ for cyan is 70 or more.

2. The material of claim 1 wherein said yellow color-forming coupler is a compound represented by the formula:

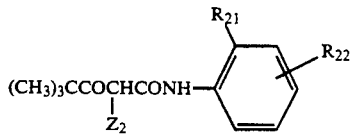

(Y-I)

wherein $R_{21}$ represents a halogen atom or an alkoxy group $R_{22}$ represents $-NHCOR_{23}SO_2R_{24}$, $-COOR_{24}$, $-NHCOR_{24}$, $-COOR_{23}COOR_{24}$, $$-\underset{\underset{R_{25}}{|}}{N}SO_2R_{24} \quad \text{or} \quad -SO_2\underset{\underset{R_{25}}{|}}{N}R_{24}$$

where $R_{23}$ represents an alkylene group; $R_{24}$ represents a diffusion-proof group; $R_{25}$ represents a hydrogen atom or an alkyl group; and $Z_2$ represents a group eliminatable by coupling.

3. The material of claim 1 wherein said magenta color-forming coupler is a compound represented by the formula:

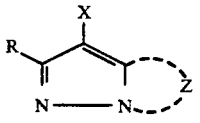

(M-I)

wherein Z represents a group of non-metallic atoms necessary for forming a nitrogen-containing heterocyclic ring and a ring represented by said Z may have a substituent group, X represents a hydrogen atom or a group eliminatable by reaction with an oxidized product of a color developing agent, and R represents a hydrogen atom or a substituent group.

4. The material of claim 1 wherein said magenta color-forming coupler is a compound represented by the formula:

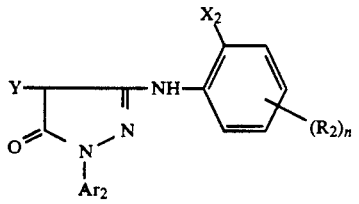

(M-XI)

wherein, $Ar_2$ represents an aryl group, $X_2$ represents a halogen atom, an alkoxy group or an alkyl group, and $R_2$ represents a group with which a benzene ring can be substituted, n represents 1 or 2, when n is 2, $R_2$'s may be the same groups or different groups, and Y represents a hydrogen atom or a group which can be eliminated by coupling reaction with an oxidized product of an aromatic primary amine type color developing agent.

5. The material of claim 1 wherein said cyan color-forming coupler is a compound represented by the formula:

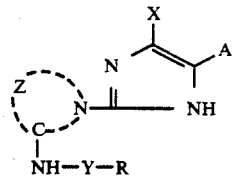

(C-I)

wherein A represents an organic group; X represents a hydrogen atom or a group eliminatable by reaction with an oxidized product of a color developing agent; Z represents a residue which can form a 5- or 6-membered heterocyclic group; Y represents a a mere bond atom or a divalent linking group and R represents a hydrogen atom or an organic group.

* * * * *